US005490675A

United States Patent [19]

Persidsky et al.

[11] Patent Number: 5,490,675

[45] Date of Patent: Feb. 13, 1996

[54] GAME SET AND STORAGE SYSTEM

[76] Inventors: Andre M. Persidsky; Maxim D. Persidsky, both of 35 Temescal Ter., San Francisco, Calif. 94118

[21] Appl. No.: 340,704

[22] Filed: Nov. 16, 1994

Related U.S. Application Data

[63] Continuation-in-part of Ser. No. 118,444, Sep. 7, 1993, Pat. No. 5,413,352.

[51] Int. Cl.[6] ..... A63F 3/02

[52] U.S. Cl. ..... 273/287; 273/260; 273/282.1; 273/283; 273/285; 273/239

[58] Field of Search ..... 273/287, 285, 273/239, 260, 148 R, 283, 282.1

[56] References Cited

U.S. PATENT DOCUMENTS

| | | | |
|---|---|---|---|
| 2,221,267 | 11/1940 | Robertson | 273/285 |
| 2,511,774 | 6/1950 | Goldsmith | 273/287 |
| 5,244,212 | 9/1993 | Bendit | 273/239 |

FOREIGN PATENT DOCUMENTS

| | | | |
|---|---|---|---|
| 352239 | 4/1986 | Germany | 273/285 |
| 1163871 | 6/1985 | U.S.S.R. | 273/260 |

*Primary Examiner*—Benjamin H. Layno
*Attorney, Agent, or Firm*—Flehr, Hohbach, Test

[57] ABSTRACT

Game set and storage system in which game pieces are stored in a preset arrangement relative to their starting positions on the game board. The set includes a game piece holder which has a plurality of compartments for holding the game pieces in an inverted position. The board is placed on the holder in an inverted position with its playing surface facing down and the board serving as a cover for the holder. To set up the game the holder is inverted with the now upright board on the under side thereof, and the board is dislodged from the holder, by pressing against the upper surface of the board with a finger inserted through a hole provided in the holder for that purpose. When the holder is lifted away, the game pieces are left in their proper starting positions on the board.

21 Claims, 12 Drawing Sheets

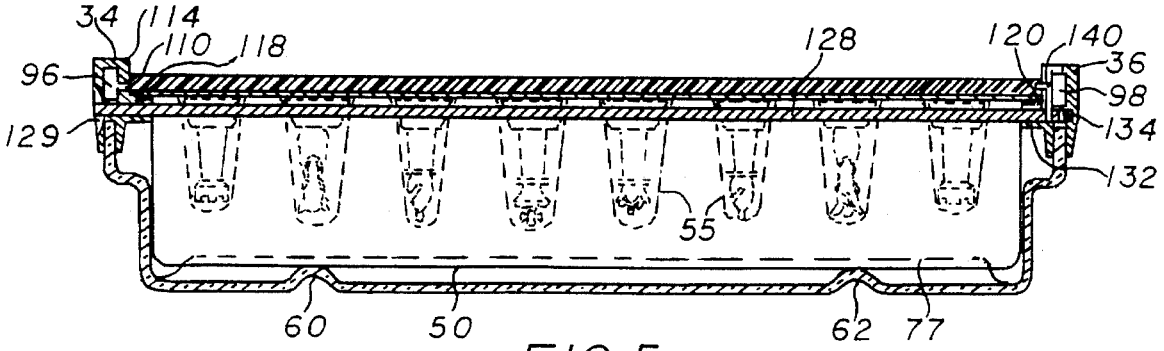
FIG. 5
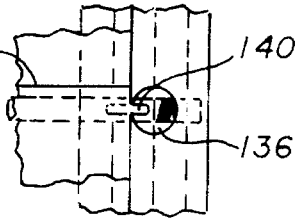
FIG. 5B
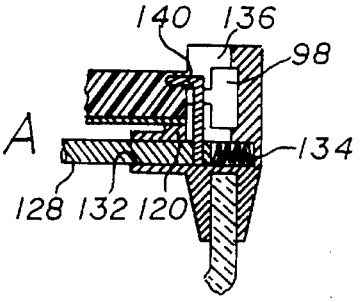
FIG. 5A
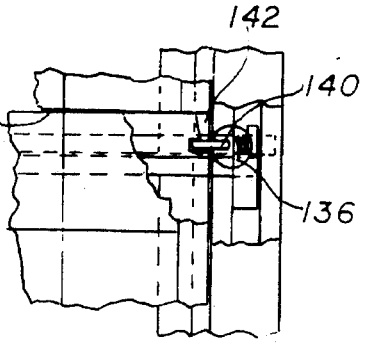
FIG. 6
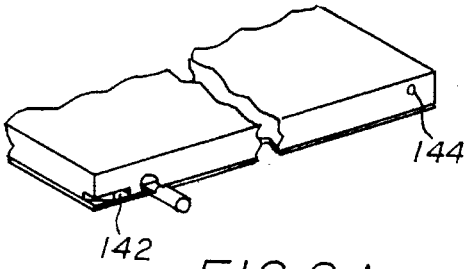
FIG. 8A
FIG. 7
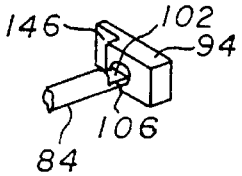
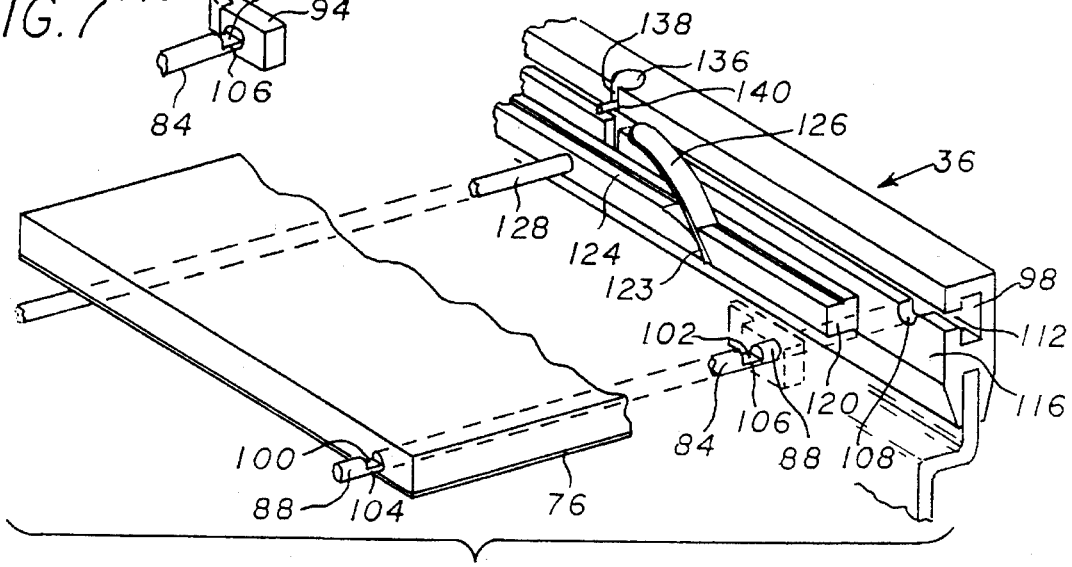
FIG. 8

170

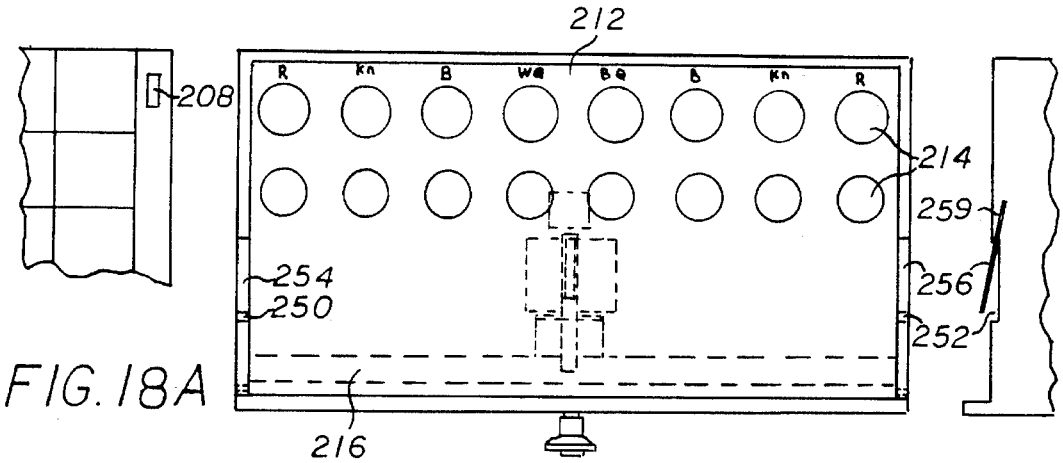
FIG. 18A
FIG. 18
FIG. 18B
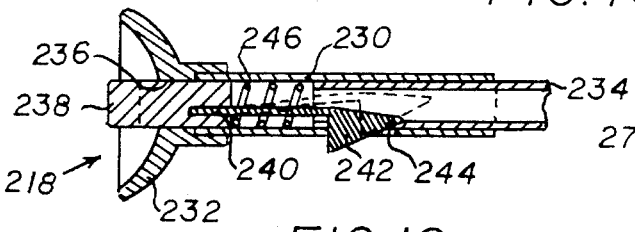
FIG. 19
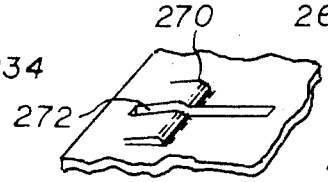
FIG. 20
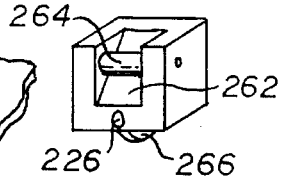
FIG. 21
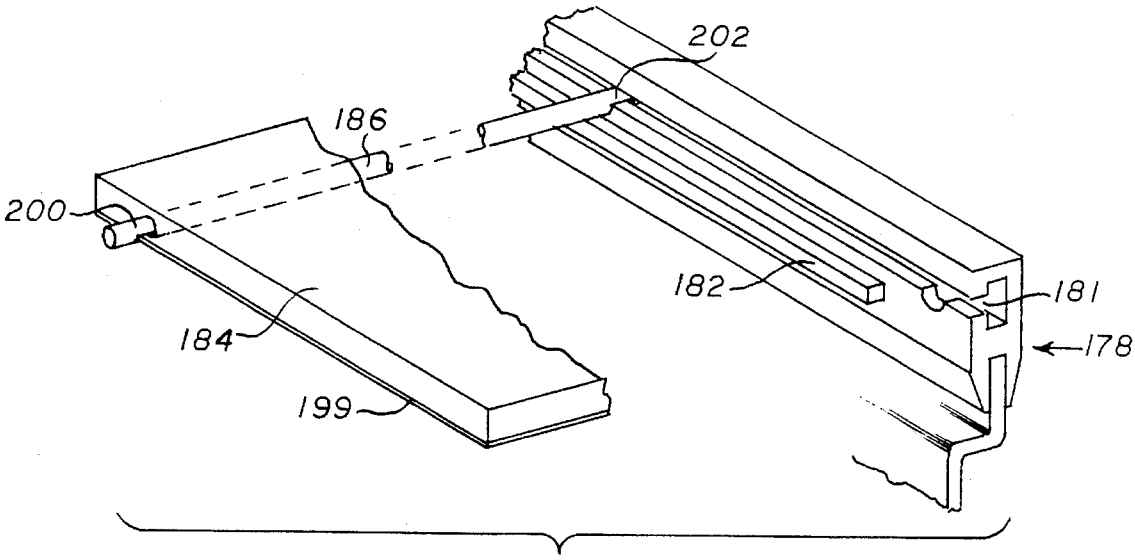
FIG. 22
FIG. 23
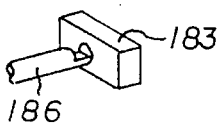

GAME SET AND STORAGE SYSTEM

CROSS-REFERENCE TO RELATED APPLICATION

This is a continuation-in-part of Ser. No. 08/118,444, filed Sep. 7, 1993 now U.S. Pat. No. 5,413,352.

BACKGROUND OF THE INVENTION

1. Field of the Invention

This invention pertains generally to board games such as chess which have a plurality of movable game pieces and, more particularly, to a game set and storage system in which the game pieces are stored in a preset arrangement relative to their starting positions on the game board.

2. Description of Related Art

One problem which players of games such as chess face is the rather tedious task of manually setting up the game pieces in the proper positions on the game board at the start of each game. This problem is aggravated when the pieces are scattered around the playing area during the game, adding to the length of time needed to arrange the chess pieces for a new game. In addition, with a game such as chess, pieces can easily be arranged improperly on the board, for example by reversing the positions of the king and queen. Discovering such a mistake after a game has begun can lead to confusion and frustration.

OBJECTS AND SUMMARY OF THE INVENTION

It is in general an object of the invention to provide a new and improved game set and storage system in which the game pieces are stored in a preset arrangement with respect to their starting positions on the game board.

Another object of the invention is to provide a game set and storage system of the above character which minimize scattering of, loss of, and damage to the game pieces.

Another object of the invention is to provide a game set and storage system of the above character which helps beginners learn the proper arrangement of game pieces on a game board, and to increase motivation for playing games such as chess by providing a preset game board.

These and other objects are achieved in accordance with the invention by providing a game set and storage system in which game pieces are automatically set in predetermined positions on a game board at the start of a game. The set includes a game piece holder which has a plurality of compartments for holding the game pieces in an inverted position. The board is placed on the holder in an inverted position with its playing surface facing down and the board serving as a cover for the holder. To set up the game the holder is inverted with the now upright board on the under side thereof, and the board is dislodged from the holder. When the holder is then lifted away, the game pieces are left behind on the board in their proper starting positions. On certain disclosed embodiments, the board is dislodged by pressing against its upper surface with a finger inserted through a hole provided in the holder for that purpose. In others, the board is held to the holder by latches which are disengaged to release the board from the holder.

BRIEF DESCRIPTION OF THE DRAWINGS

FIG. 5 is a cross-sectional view taken along line 5—5 in FIG. 2.

FIG. 5A is a fragmentary enlarged sectional view of a locking rod and rail in the embodiment of FIG. 1.

FIG. 5B is a fragmentary top plan view of a locking rod and spring in the embodiment of FIG. 1.

FIG. 6 is a fragmentary top plan view, partially broken away, of the embodiment of FIG. 1, illustrating one half of the game board locked in a playing position.

FIG. 7 is a fragmentary isometric view of a pivot assembly in the embodiment of FIG. 1.

FIG. 8 is a fragmentary isometric view, partly broken away, of the embodiment of FIG. 1, illustrating one half of the game board in a closed position.

FIG. 8A is a fragmentary isometric view of the right side of one half of the game board in the embodiment of FIG. 1.

FIG. 18 is a top plan view of a drawer in the embodiment of FIG. 13.

FIG. 18A is a fragmentary top plan view of one half of the game board in the embodiment of FIG. 13.

FIG. 18B is a fragmentary side elevational view of the drawer shown in FIG. 18.

FIG. 19 is an enlarged, fragmentary, sectional view of a locking handle in the embodiment of FIG. 13.

FIG. 20 is a fragmentary axonometric view of the bottom surface of the drawer shown in FIG. 18.

FIG. 21 is an axonometric view of a portion of a locking mechanism for the drawer shown in FIG. 18.

FIG. 22 is a fragmentary isometric view of the embodiment of FIG. 13, showing one half of the game board in the closed position.

FIG. 23 is an isometric view of a pivot mechanism in the embodiment of FIG. 13.

DETAILED DESCRIPTION

Figure 1:
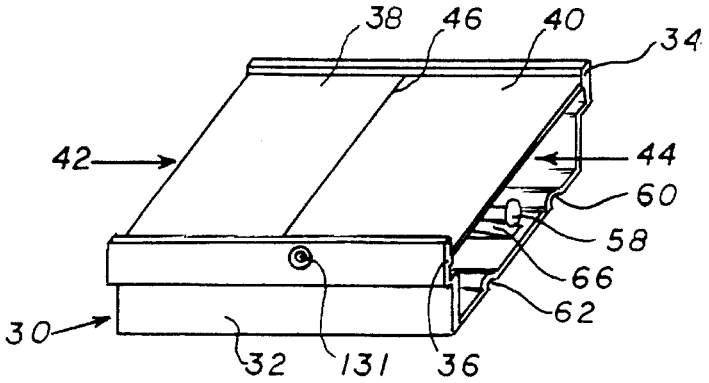
FIG. 1 is an axonometric view of a first embodiment of a game set and storage system according to the invention.
Figure 2:
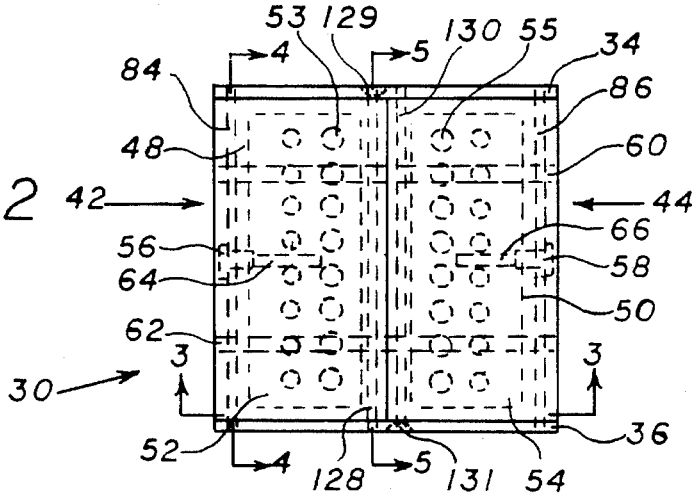
FIG. 2 is a top plan view of the embodiment of FIG. 1.

In FIGS. 1 and 2, a self-setting chessboard game device or chess box 30 is shown in the closed position. Chess box 30 consists of two structurally identical sides, with a center dividing line 46. Chess box 30 consists of a trough 32 having open ends on opposite sides. Attached to trough 32 are identical chess box rails 34, 36 shown in greater detail in FIG. 4. Trough 32 is preferably constructed out of a plastic material and chess box rails 34, 36 are constructed preferably out of aluminum. The upper surface enclosing chess box 30 consists of the back surfaces 38, 40 of the respective identical and separate chessboard halves or board halves 42, 44 with center dividing line 46 formed where the two boards halves 42, 44 meet. Board halves 42, 44 are each supported by chess box rails 34, 36.

Figure 3A:
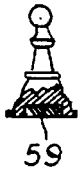
FIG. 3A is a side elevational view, partly broken away, of one of the game pieces in the embodiment of FIG. 1.
Figure 3:
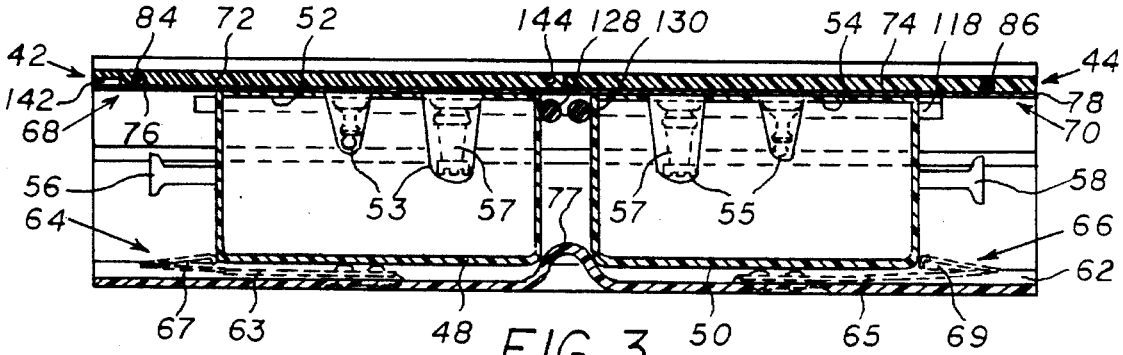
FIG. 3 is a cross-sectional view taken along line 3—3 in FIG. 2.
Figure 4:
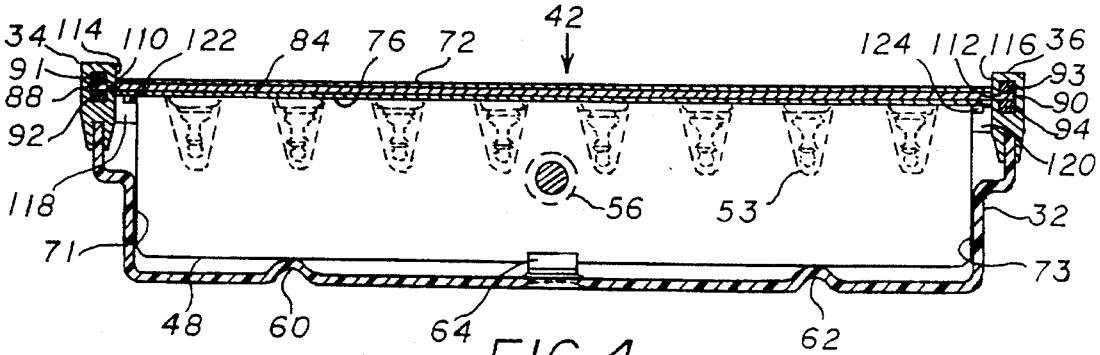
FIG. 4 is a cross-sectional view taken along line 4—4 in FIG. 2.

As indicated by phantom lines in FIG. 2, chess box 30 contains two rectangular drawers 48, 50. Drawers 48, 50 are also visible in cross-sectional view in FIG. 3, and in a top plan view in FIG. 12 where they have been removed from chess box 30. A frontal view of drawer 48 is shown in FIG. 4. Drawers 48, 50 are preferably made of plastic material. The upper side of each drawer is covered by chess piece holder plates or holder plates 52, 54, preferably made of plastic shown in FIG. 2. Holder plates 52, 54 have compartments 53, 55, shown in FIG. 3. Compartments 53, 55 are conical in shape and are each arranged in two rows, with 8 compartments per row, for holding chess pieces 57 in an upside down position, shown from the top in FIG. 12, and in sectional and cutaway views in FIGS. 3, 4, and 5. Each chess piece 57 has a cylindrical magnet 59 positioned in its base as shown sectionally in FIG. 3A. The top rows of compartments 53, 55 are labeled by abbreviated chess piece names 61, R for rook, Kn for knight, B for bishop, WQ for white queen, and BQ for the black queen, shown in FIG. 12. The reason that there are two queen labels (WQ—white queen, BQ—black queen) and no king label for each holder plate 52, 54 is to make drawers 48, 50 interchangeable. For example, in FIG. 12, if drawer 48 is put in the place of drawer 50, the orientation of the white queen with respect to the chessboard remains the same, that is, the white queen is still four squares from the left in the top row of the drawer. The king label is omitted but he is placed after a game into the queen compartment which is not occupied by the queen. The bottom rows of compartments 53, 55 contain the pawns of chess pieces 57 and are not labeled. Compartments 53, 55 are of appropriate size to accommodate the different size of chess pieces 57, and the compartment walls are very thin as shown in FIGS. 3 and 5. Drawers 48, 50 have handles 56, 58 (FIG. 3) attached to their front side. At the bottom of trough 32, there are two drawer rails 60, 62 shown in FIGS. 1, 2, and 4, upon which drawers 48, 50 slide. Drawer rails 60, 62 also function to strengthen trough 32, and provide clearance for drawer locks 64, 66 shown with phantom lines in FIG. 2, and in FIG. 3. Drawer locks 64, 66 each consists of a flat spring 63, 65 attached to the bottom of trough 32. Flat springs 63, 65 have triangular catches 67, 69 at their free ends, functioning to prevent drawers 48, 50 from sliding out by catching the bottom edges of the front walls of the drawers shown in FIG. 3. Drawers 48, 50 are prevented from horizontally sliding during removal by guide walls 71, 73, and by ledges 118, 120 shown in FIG. 4. Trough 32 has a center ridge 77 traversing the width of chess box 30 shown in FIG. 3. Center ridge 77 stops drawers 48, 50 near the center of chess box 30, and also functions to strengthen trough 32.

Figure 10:
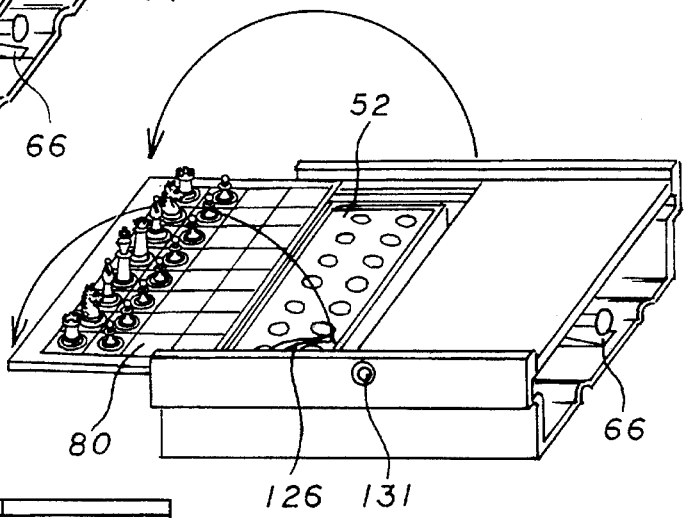
FIG. 10 is a view similar to FIG. 1, with one half of the game board rotated 180° about a horizontal axis and the game pieces set in position on it.

In the closed position of chess box 30, the playing sides 68, 70 of board halves 42, 44 face downwards against holder plates 52, 54 of drawers 48, 50 as shown in FIG. 3. The board halves 42, 44 each consist of a rectangular plastic sheet 72, 74 to which are attached thin rectangular steel sheets 76, 78. Steel sheets 76, 78 are attached to the playing sides 68, 70 of boards halves 42, 44 and each steel sheet is of the same size as its corresponding plastic sheet. The outer surfaces of steel sheets 76, 78 are covered by chessboard stickers 80, 82 each carrying one half of the chessboard pattern shown in FIGS. 10, 11, and 12. Stickers 80, 82 each covers the entire surface of its corresponding steel sheet and each sticker carries 32 checker squares and has borders on three of its sides. Chessboard stickers 80, 82 are positioned on steel sheets 76, 78 so that the centers of compartments 53, 55 below line up with the centers of the appropriate squares on the stickers. In the closed position of chess box 30, inverted chess pieces 57 are magnetically attached to steel sheets 76, 78, onto the centers of the corresponding squares of chessboard stickers 80, 82 shown in FIG. 5. At the outer ends of each board half 42, 44 there are fixedly attached metal chessboard shafts 84, 86 embedded into plastic sheets 72, 74 as shown in cross-sectional view in FIG. 3. Shafts 84, 86 traverse the width of each board half 42, 44 as shown in sectional view for board half 42 in FIG. 4. Shafts 84, 86 protrude on both sides of each board half as shown for shaft 84 in FIG. 8. The protruding fixed ends of shaft 84 form pivots 88, 90 around which board half 42 can rotate. Shaft 86 of board half 44 has similar pivots (not shown). Pivots 88, 90 are shown in sectional view in FIG. 4 protruding from both sides of board half 42 and entering holes 91, 93 of rectangular bars 92, 94. FIG. 7 shows pivot 90 residing in hole 93 of bar 94. Holes 91, 93 provide the bearings around which shaft 84 with its attached board half 42 rotate as shown in FIG. 10. The other Board half 44 also has two similar bars pivotally attached to its shaft to form the same pivoting arrangement as for board half 42 (not shown).

Bars 92, 94 are contained by and slide in channels 96, 98 of chess box rails 34, 36. Channels 96, 98 are shown in FIG. 5 and channel 98 is also shown in FIGS. 5A and 8. Channels 96, 98 traverse the entire lengths of chess box rails 34, 36. Channels 96, 98 are both closed off at each of their ends so as to prevent bars 92, 94 from sliding out. In FIG. 8 though, channel 98 is shown open at its end for the purpose of clarity. Channels 96, 98 are T-shaped in cross section, and have open slots or channel slots 110, 112 along the inner walls 114, 116 of their respective chess box rails 34, 36 as shown in FIG. 4 and partially in FIG. 8. Channel slots 110, 112 traverse the entire length of their chess box rails 34, 36 and these slots are equal in height to the radius of chessboard shafts 84, 86. The bars used with board half 44 are identical to bars 92, 94 of board half 42, also slide in channels 96, 98 at the opposite half of chess box 30 (not shown). A section near each pivot 88, 90 of chessboard shaft 84 is cutout to form semi-cylindrical gaps 100, 102 and semi-cylindrical portions 104, 106 as shown in FIG. 8. Chessboard shaft 86 has identical semi-cylindrical gaps and portions similarly positioned next to each pivot (not shown). In the closed position of chess box 30, semi-cylindrical portion 106 (FIG. 8) of chessboard shaft 84 faces downwards and is contained by a semi-cylindrical indentation 108 in inner wall 116, situated at the outer end of chess box rail 36. Semi-cylindrical indentation 108 is positioned so that the central axes of shaft 84 lies in the plane of the bottom surface of channel slot 112 of chess box rail 36 as shown in FIG. 4 and in a partially exploded view in FIG. 8. Semi-cylindrical portion 104 of chessboard shaft 84 is also similarly contained by a semi-cylindrical indentation in inner wall 114 of chess box rail 34 (not shown). The semi-cylindrical portions of shaft 86 of the other chessboard half 44 are also each similarly contained by a semi-cylindrical indentation, one in each inner wall of each chess box rail (not shown). Ledges 118, 120 are attached to inner walls 114, 116 of chess box rails 34, 36 as shown in FIG. 4. Board halves 42, 44 can slide along these ledges as shown for board half 42 in FIG. 11. The outer ends of ledges 118, 120 are cut out to provide room for the rotation of board halves 42, 44 as shown for ledge 120 in FIG. 8 for board half 42.

Ledges 118, 120 have inner steps 122, 124 shown in FIG. 4 and partially shown in FIG. 8. Inner steps 122, 124 traverse the lengths of ledges 118, 120. Inner step 124 of ledge 120 holds a flat spring 126, (FIG. 8) secured at one end by being pressed into a diagonal slot 123 made in inner step 124. In both the closed and playing position of chess box 30, flat spring 126 is depressed by board half 42 so that it is flush with the surface of the top step of ledge 120. Inner step 122 of ledge 118 also has a flat spring similarly positioned on the side of board half 44 (not shown).

Chess box 30 contains two locking rods 128, 130 (see FIG. 2), functioning to secure board halves 42, 44 in place. Locking rods 128, 130 are centrally positioned as shown in cross section in FIG. 3, and each spans the width of chess box 30. Locking rod 128 is shown in longitudinal cross section in FIG. 5. Chess box rails 34, 36 contain button recesses 129, 131 (FIG. 2) which house the ends of locking rods 128, 130. Button recess 129 is formed below channel 96 and goes all the way through ledge 118 as shown in FIG. 5. A hole 132 is located in chess box rail 36 directly on the opposite side of button recess 129. Hole 132 goes through ledge 120 and partially through chess box rail 36 below channel 98, shown in detail in FIG. 5A. Hole 132 contains a helical spring 134. The end of locking rod 128 is contained in hole 132 and presses against helical spring 134. The top surface of chess box rail 36 has a vertical hole 136 (FIG. 5B), positioned so that it intersects with hole 132, and forms a vertical slot 138 at the edge of inner wall 116, shown in FIG. 8 and shown sectionally in FIG. 5A. A hook 140 is contained in vertical hole 136 (FIG. 5A) and is attached to the end of locking rod 128 below. Hook 140 protrudes out of slot 138 and prevents helical spring 134 from pushing locking rod 128 out of hole 132 by catching ledge 120. Board half 42 has a locking slot 142 and a locking hole 144 in its right side wall shown in FIG. 8A. In the closed position of chess box 30, hook 140 rests in locking hole 144, securing board half 42 in place as shown in FIG. 5A and FIG. 5B. In the playing position of chess box 30, hook 140 rests in locking slot 142 (FIG. 6) which is shaped so as to allow hook 140 to temporarily recede into channel 98 while board half 42 is being slid along ledge 120 into the locked playing position. A cutout 146 is made in bar 94 to accommodate hook 140 as it temporarily recedes into channel 98 while entering locking slot 142 (FIGS. 6, 7). The locking mechanism for board half 44 with locking rod 130 is identical to that of board half 42 with locking rod 128 (not shown).

Figure 9:
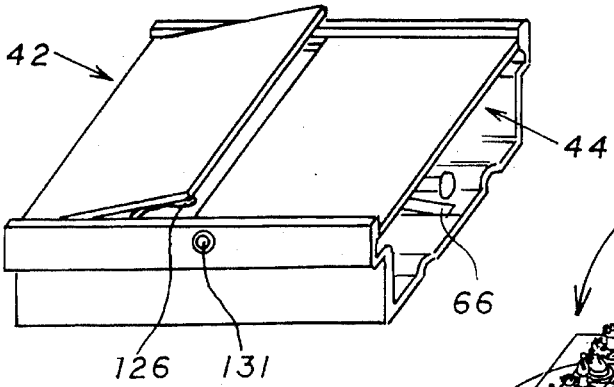
FIG. 9 is a view similar to FIG. 1, with one half of the game board in a partially open position.

Chess box 30 has two structurally identical and independently operated halves each controlled by one of the two players. In FIG. 9, board half 42 is unlocked by pressing the protruding end of locking rod 128, positioned in button recess 129 shown in FIG. 5. This action pushes hook 140 out of locking hole 144 and into channel 98 thus allowing fiat spring 126 (FIG. 8) to elevate board 42 into the position shown in FIG. 9. The player then grabs the corners of the elevated side of board haft 42 and rotates it 180 degrees around pivots 88, 90 into the position shown in FIG. 10. Since chess pieces 57 are magnetically attached upside down to steel sheet 76 of board half 42 (FIG. 3), rotating board half 42 (FIG. 10) lifts chess pieces 57 out of their compartments 53. This action constitutes the self-setting process here.

The semi-cylindrical indentations, such as semi-cylindrical indentation 108, permit shafts 84, 86 of board halves 42, 44 to rotate around their pivots while preventing sliding motion of shafts 84, 86 along channel slots 110, 112 when the semi-cylindrical portions of the shafts are partially or completely contained in the semi-cylindrical indentations as shown partially for shaft 84 in FIG. 8. This is important since it prevents a partially rotated board half 42 for instance from sliding underneath ledge 120 whereupon damage from leverage to the board half could be sustained. However, when board half 42 is rotated 180 degrees from the closed position of chess box 30 as in FIG. 10, so that the board half's playing side faces upwards, semi-cylindrical portions 104, 106 of its fixedly attached shaft will also be rotated into an upward position completely out of the semi-cylindrical indentations and into channel slots 110, 112. Since channel slots 110, 112 are equal in height to the radius of chessboard shafts 84, 86, semi-cylindrical portions 104, 106 of shaft 84 can now slide freely along these slots, permitting bars 92, 94 to slide in channels 96, 98, while carrying board half 42 along with them as is the case in FIG. 11. When the semi-cylindrical portions of the chessboard shafts are in the channel slots and away from the semi-cylindrical indentations, the shafts can no longer rotate and the board halves are fixed in a horizontal position while they are being slid on ledges 118, 120.

Figure 11:
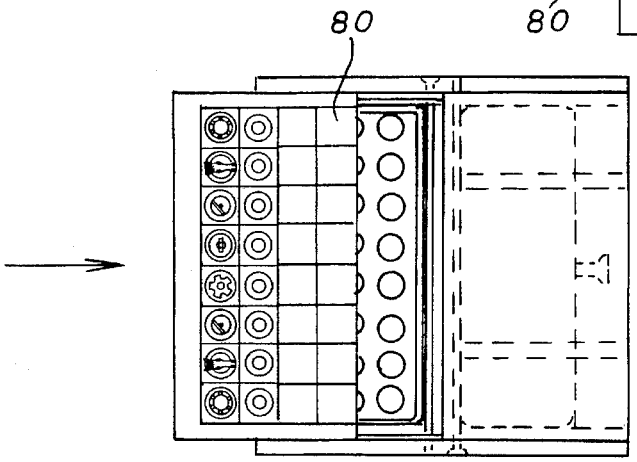
FIG. 11 is a top plan view of the embodiment of FIG. 1, with one half of the game board facing upright and the game pieces set in position on it.

As illustrated in FIG. 11, the player slides board half 42 into the locked playing position. Board half 42 is shown in the locked playing position in FIG. 6. As board half 42 enters this position, hook 140 enters the angled locking slot 142 which temporarily presses it through vertical slot 138 into channel 98. As board half 42 slides forward, helical spring 134 then pushes locking rod 128 causing attached hook 140 to be pushed out of channel 98 and into its final locked state in FIG. 6. Cutout 146 in bar 94 accommodates hook 140 as it temporarily recedes into channel 98 shown in FIGS. 6 and 7.

Figure 12:
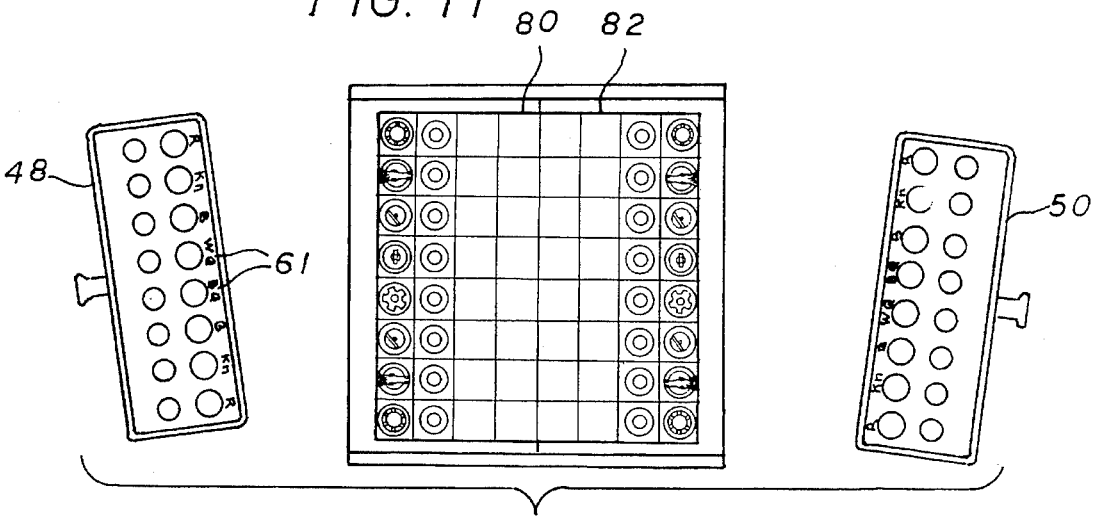
FIG. 12 is a top plan view of the embodiment of FIG. 1, with the game board in a playing position with the game pieces on it and the two drawers removed from the case.

Once board half 42 is in the locked playing position, drawer 48 is removed through depressing the triangular catch 67 on drawer lock 64, shown in FIG 3. Drawer 48 is placed beside chess box 30 as shown in FIG. 12. The same exact operational steps are performed by the other player to place board half 44 into the playing position. When both chessboard halves 42, 44 have been set and both drawers removed (FIG. 12), the game can proceed. Play differs from standard play only in that when a player catches one of the opponent's pieces, instead of placing it on the table top, he or she immediately redeposits it upside down into the appropriately labeled compartment in his or her drawer. By refilling the drawers in this manner, the players are in effect progressively resetting the chess box piece by piece for the next game, but not losing time doing so since the captured pieces must be deposited someplace anyway. The only exception is that sometimes chess games are ended through draws or resignations with many pieces still remaining on the chessboard. In this scenario, the players simply need to redeposit their opponents' remaining chess pieces into their drawers. Even this situation will require less work than setting up a regular chessboard from scratch since only the remaining pieces need to be transferred to the drawers.

When a game is ended and drawers 48, 50 have been refilled with chess pieces 57, a new game can begin by resetting chess box 30. This is accomplished by placing board halves 42, 44 back into the closed position through reversing the opening steps detailed in FIGS. 9–12, and then reinserting drawers 48, 50 into chess box 30.

The first step to close board half 42 is to press the protruding end of locking rod 128 while pulling on board half 42 to release it from hook 140 (FIG. 11). Board half 42 is then slid back to its furthest position as in FIG. 10, and then rotated 180 degrees to the position shown in FIG. 9. At this point, board half 42 rests on flat spring 126. To lock it into the closed position as in FIG. 1, the protruding end of locking rod 128 is pressed while pushing down on board half 42. Locking rod 128 is then released which locks hook 140 into locking hole 144 as in FIG. 5B. The same exact operational steps are performed on board half 44 to place it into the closed position.

Once board halves 42, 44 are in the closed position, drawers 48, 50 containing inverted chess pieces 57 are reinserted into chess box 30, where chess pieces 57 automatically line up and magnetically attach to the appropriate squares of inverted board halves 42, 44 as shown in FIG. 3. Drawers 48, 50 are also automatically locked into place by drawer locks 64, 66. Chess box 30 is now ready for a new game. Since each drawer contains the opponent's pieces from the last game, the black and white sides are now reversed, which is normal since players usually alternate sides after each game. Drawers 48, 50 are interchangeable. Interchanging them will not cause chess pieces 57 to be improperly aligned.

A second embodiment of a chess set and storage box 170 is shown in FIGS. 13 through 17. Chess box 170 has two structurally identical halves, therefore only the left half in FIG. 14 of chess box 170 is described in detail. Excluding the drawers, the components of chess box 170 and chess box 30 (FIG. 1) are similar in many ways. Therefore, chess box 170 is described below in terms of its differences and similarities to chess box 30.

In this embodiment, chess box 170 employs a trough 172 similar to trough 32 (FIG. 4) with the only exceptions being that trough 172 is higher to accommodate taller chess pieces 174, and trough 172 does not have rails similar to drawer rails 60, 62 shown in FIG. 4 also shown with dotted lines in FIG. 2. Chess pieces 174 have cylindrical magnets positioned in their bases just as chess pieces 57 in FIG. 3A. Attached to trough 172 are a pair of chess box rails or rails 176, 178, shown in FIG. 15. They are similar to chess box rails 34, 36 (FIG. 4) in structure, with certain exceptions which are best seen by comparing FIG. 22 to FIG. 8. Rails 176, 178 do not incorporate any locking rods like locking rods 128, 130 of chess box rails 34, 36. Rails 176, 178 do not have diagonal slots such as diagonal slot 123, button recess 131, hole 132 (FIG. 5), vertical hole 136 (FIG. 8), or vertical slot 138, which are provided in chess box rails 34, 36. Furthermore, the ledges 180, 182 of rails 176, 178 (FIG. 15) do not have inner steps like inner steps 122, 124 of chess box rails 34, 36 (FIG. 4). Concerning similarities to chess box rails 34, 36, rails 176, 178 contain channels 179, 181 (FIG. 15), similar to channels 96, 98 (FIG. 5) in chessboard rails 34, 36. Channels 179, 181 also carry a pair of bars for each side of chess box 170, similar to bars 92, 94 of chess box 30, shown sectionally in FIG. 4. In FIG. 23, a bar 183 is shown pivotally attached to a metal chessboard shaft 186, identical to chessboard shafts 84 or 86 of chess box 30. Bar 183 slides in channel 181 of rail 178, and is different from bar 94 (FIG. 7) of chess box 30 only in that it lacks cutout 146. In the closed position of chess box 170, bar 183 as well as chessboard shaft 186 are near the middle of rail 178 as shown in FIG. 22. This is different from chess box 30, where in the closed position, bar 94 and chessboard shaft 84 are at the end of rail 36 as in FIG. 8. The result of this difference is that the opening and closing operations of chess box 170 are different from chess box 30 (see operational section).

Figure 15:
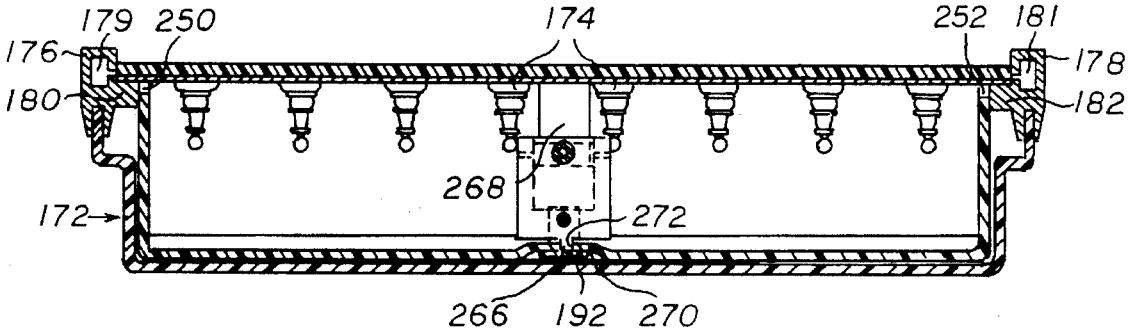
FIG. 15 is a cross-sectional view taken along line 15—15 in FIG. 14.

In FIG. 22, one half 184 of the chessboard is shown in the closed position of chess box 170, with its playing side 199 facing downwards. Board half 184 rests on ledges 180, 182 as shown in FIG. 15, and in FIG. 22 for ledge 182.

Board half 184 is similar in construction to board half 42 (FIG. 8) by making use of similar plastic and steel sheets and chessboard sticker. Board half 184 differs from board half 42 in terms of the position of its fixed chessboard shaft 186 (FIG. 22), and in that it does not have a locking slot such as locking slot 142, or locking hole 144 in its right side as does board half 42 in FIG. 8A. The other difference in board half 184 is the presence of grooves 206, 208, positioned opposite from each other in the border areas on playing side 199, shown in FIG. 17 and 18A. In the closed position of chess box 170 in FIG. 22, chessboard shaft 186 is at the opposite end of board half 184 (compared to chessboard shaft 84 of board half 42 in FIG. 8), and is rotated 180 degrees so that its remaining semi-cylindrical portions 200, 202 face upwards.

Figure 13:
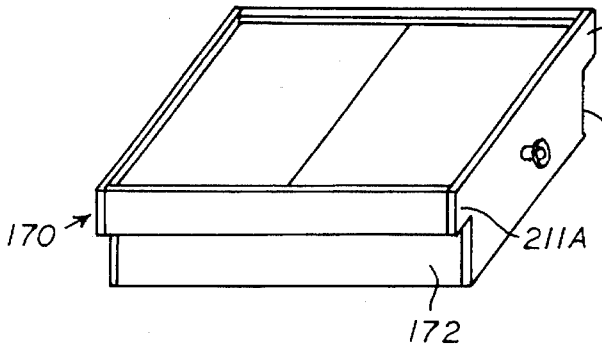
FIG. 13 is an axonometric view of a second embodiment of a game set and storage system according to the invention.
Figure 14:
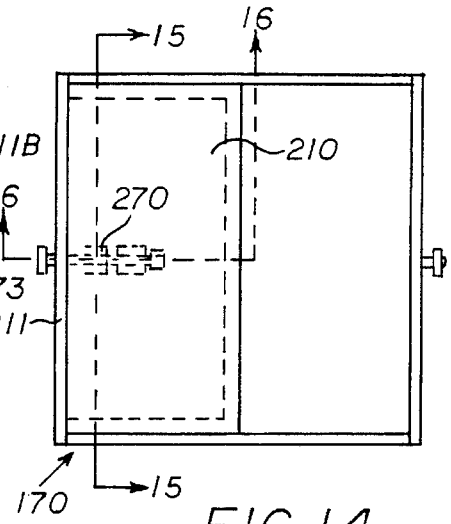
FIG. 14 is a top plan view of the embodiment of FIG. 13.
Figure 16:
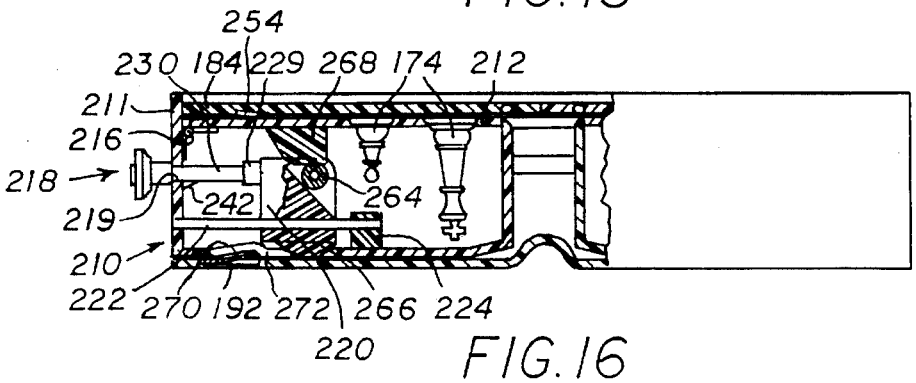
FIG. 16 is a fragmentary cross-sectional view taken along line 16—16 in FIG. 14.
Figure 16A:
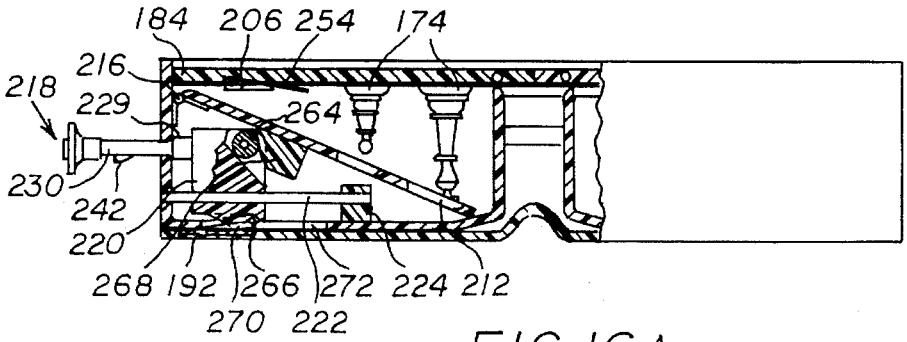
FIG. 16A is a view similar to FIG. 16, showing a game piece holder in a lowered position.
Figure 16B:
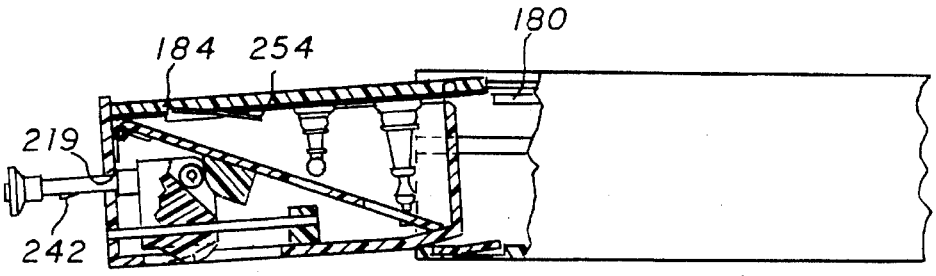
FIG. 16B is a view similar to FIG. 16A, showing a drawer and one half of the game board partially removed.
Figure 16C:
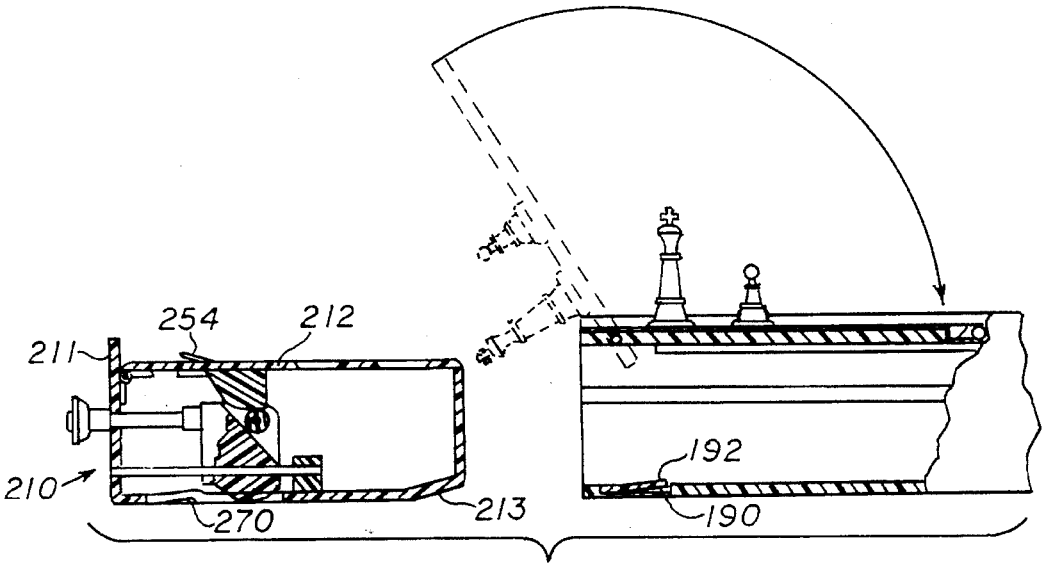
FIG. 16C is a view similar to FIG. 16B, showing the drawer completely removed and game board half rotated to an upright position.
Figure 17:
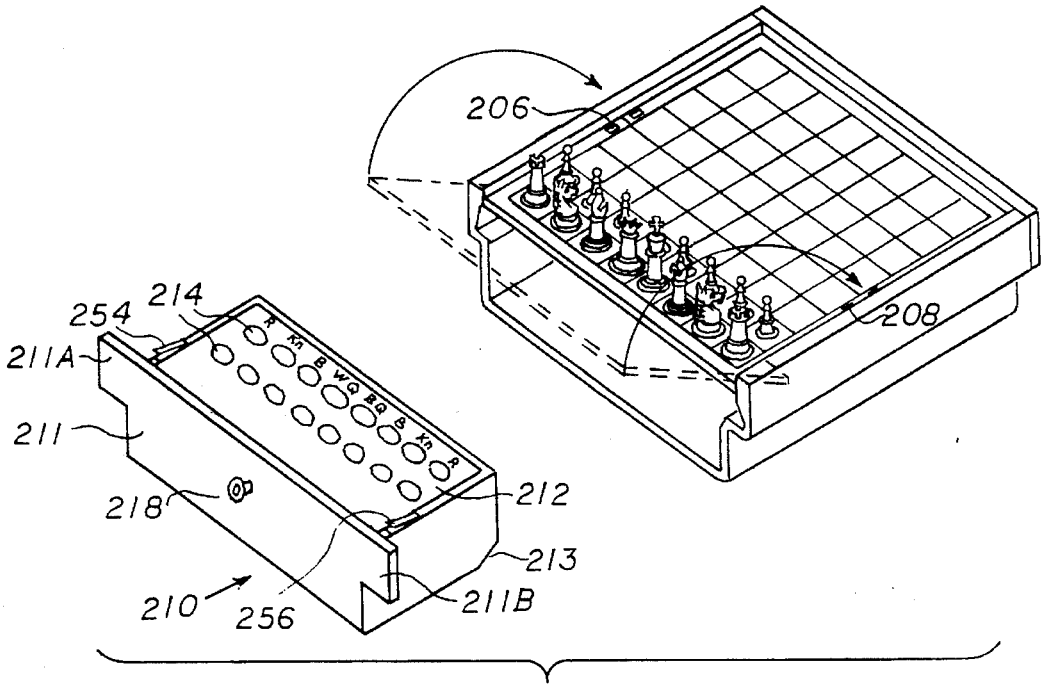
FIG. 17 is an isometric view of the embodiment of FIG. 13, with one drawer removed, the game board in a playing position, game pieces on one half of the board.

A drawer 210, contained in chess box 170, is shown with dotted lines in FIG. 14, sectionally in FIG. 16, and shown removed from chess box 170 in FIG. 17. A front wall 211 of drawer 210 extends above the top surface of drawer 210, as shown in FIG. 16C. When drawer 210 is locked inside chess box 170, this extension of front wall 211 prevents board half 184 from sliding out as shown in FIG. 16. In FIG. 17, front wall 211 has extended flaps 211A, 211B on each of its sides, used to cover up the ends of rails 176, 178 when drawer 210 is locked inside chess box 170 as in FIG. 13. The body of drawer 210 is rectangular in shape with the exception being that the bottom surface of the drawer is raised at the back to form a ramp 213 where it meets the back wall as in FIG. 16C and FIG. 17. The top surface of drawer 210 is enclosed by a lowerable chess piece holder plate or holder plate 212, shown in FIGS. 17, 18, and sectionally in FIG. 16C. Holder plate 212 contains 16 compartments 214, arranged into two rows of eight (FIG. 17), each of appropriate size to hold chess pieces 174 by their bases in an upside down position as in FIGS. 15 and 16. Compartments 214 are labeled with abbreviations in the top row for the corresponding chess pieces they hold, shown in FIG. 18. Holder plate 212 is attached to a hinge 216, which in turn is secured to the inner side of front wall 211 of drawer 210, visible in FIG. 16. Hinge 216 traverses the width of drawer 210, as shown with dotted lines in FIG. 18. In the locked position of drawer 210, hinge 216 is at 90 degrees so that holder plate 212 is parallel to the bottom surface of drawer 210 as in FIG. 16. In FIG. 16A, when drawer 210 is unlocked, hinge 216 allows holder plate 212 to rotate downward to the bottom of drawer 210, thus freeing chess pieces 174. The tops of the side walls of drawer 210 contain rectangular cutouts or cutouts 250, 252, as shown from a top view in FIG. 18 and a side view in FIG. 18B. Cutouts 250, 252 contain flat springs 254, 256, secured by being pressed into diagonal slots 257, 259 in the back corners of cutouts 250, 252 as in FIG. 18B (not shown for slot 257). In FIG. 16 and 16A, the protruding end of flat spring 254 rests inside groove 206 of board half 184. The protruding end of flat spring 256 also rests inside groove 208 on the other side of drawer 210 (not shown). In FIG. 16B, when drawer 210 is being removed from chess box 170, the protruding ends of flat springs 254, 256 pull board half 184 out with drawer 210, along ledges 180, 182.

As illustrated in FIG. 16, drawer 210 has a locking handle 218. Locking handle 218 protrudes from the center of front wall 211 (FIG. 17) and has a metal tube 230 (FIG. 19), which goes through a hole 219 in the center of front wall 211, as in FIG. 16. Tube 230 is attached to a cube 220 by a flange 229, which stops locking handle 218 in an appropriate position in its unlocked pulled out state as in FIG. 16A. Locking handle 218 consists of metal tube 230 on the end of which is attached a round knob 232, shown sectionally in FIG. 19. Tube 230 contains a fixed inner tube 234. Knob 232 has a hole 236 through its center, containing a movable button 238, attached to a flat spring 240. Flat spring 240 has a thin triangular catch 242 on its free end, which protrudes out of a slot 244 contained in tube 230 when button 238 is not depressed. In FIG. 16 in the locked position of drawer 210, triangular catch 242 prevents locking handle 218 from being pulled out of hole 219 by catching wall 211. In tube 230, the space between button 238 and the opening of inner tube 234 contains a helical spring 246, shown in FIG. 19. Helical spring or spring 246 is wider in diameter than inner tube 234 to stop it from sliding into inner tube 234. When button 238 is depressed, spring 246 is compressed against inner tube 234 while triangular catch 242 is pushed out of slot 244 and slid into inner tube 234 as shown with dotted lines in FIG. 19. This action allows locking handle 218 to be pulled out of drawer 210 as in FIG. 16A. When this is done, drawer 210 is unlocked from chess box 170, and holder plate 212 is in the lowered position.

Holder plate 212 is lowered through the sliding motion of cube 220. As illustrated in FIG. 21, the body of cube 220 has a triangular cutout 262 housing a roller 264. At the bottom of cube 220 there is a cam 266 attached to it as shown in FIGS. 16 and 21. Referring to FIGS. 16 and 16A, cube 220 rides along a rod 222, which is supported by the inner side of front wall 211 as well as a block 224 inside drawer 210. Rod 222 goes through a hole 226 in cube 220, shown in FIG. 21. On the bottom side of holder plate 212 is attached a supporting cam 268 shown in FIG. 15 and sectionally in FIG. 16. Supporting cam 268 has a trapezoidal profile as shown in FIG. 16. In FIG. 16C, on the bottom surface of chess box 170, there is a recess 190 which holds a flat spring 192 with a protruding end, shown sectionally. Flat spring 192 catches an indentation 270 at the bottom of drawer 210, and locks drawer 210 to chess box 170. FIG. 20 shows an enlarged portion of the bottom surface of drawer 210 containing an indentation 270 used to catch flat spring 192. Indentation 270 is visible with dotted lines from the top in FIG. 14, and from the side in FIG. 16C in drawer 210. In the locked position of drawer 210 in FIGS. 15 and 16, the protruding end of flat spring 192 is shown caught in indentation 270 preventing drawer 210 from sliding out. In FIG. 20, indentation 270 has a longitudinal cam groove 272 running through its center. Cam 266 moves in cam groove 272 as shown in FIG. 15 and 16. In FIG. 16A, when locking handle 218 is in the pulled out position, cam 266 depresses flat spring 192 out of indentation 270 thereby freeing drawer 210 to be pulled out of chess box 170 as in FIG. 16B.

Since chess box 170 has two identical and independently operated halves, operations for the left half only in FIG. 14 are described.

Locking handle 218 is the only mechanism a player operates to lock and unlock all aspects of one side of chess box 170, including locking and unlocking holder plate 212, drawer 210, and board half 184. This is in contrast to the embodiment of FIG. 1 where separate drawer locks and chessboard half locks are used. In the locked position of drawer 210, holder plate 212 is maintained in its elevated position by supporting cam 268 which rests with its flat head side on roller 264. When locking handle 218 is pulled out of drawer 210, cube 220 slides towards front wall 211 and its roller 264 rolls from the flat side of supporting cam 268 (FIG. 16A) to its inclined side thereby lowering holder plate 212. When unlocking drawer 210, button 238 of knob 232 is depressed while locking handle 218 is pulled out of drawer 210. In addition to lowering holder plate 212, this action unlocks drawer 210 from chess box 170 by cam 266 pushing flat spring 192 out of indentation 270. Further pulling on locking handle 218 now slides drawer 210 out of chess box 170 to its position in FIG. 16B. Flat springs 254, 256 (FIG. 18) pull board half 184 out by its grooves 206, 208 along with drawer 210. Board half 184 stops drawer 210 in its position in FIG. 16B since the bars attached to chessboard shaft 186 have reached the closed ends of channels 179, 181 (not shown).

Referring now to FIG. 16C, board half 184 is now lifted off of drawer 210 by its edges, and rotated 180 as shown by the arrow. Holder plate 212 is shown elevated here, but it is raised only after board half 184 has been rotated. Lowered holder plate 212 (shown in FIG. 16B) allows chess pieces 174 to be freely rotated out of drawer 210 into their playing position. Chess pieces 174 are rotated through being magnetically held to the steel sheet on board half 184 as in FIG. 16C. As board half 184 rotates, the edge closest to the axes of rotation pushes drawer 210 out of chess box 170 (FIG. 16C). Ramp 213 is provided so that drawer 210 can gradually fall off the bottom edge of trough 172, and also to facilitate the easy reinsertion of drawer 210. During the rotation of board half 184, semi-cylindrical portions 200, 202 (FIG. 22) are contained in semi-cylindrical indentations just as in chess box 30 so as to prevent sliding motion of board half 184 during rotation.

Once board half 184 has been rotated into its playing position (FIG. 16C), drawer 210 (which is now removed as in FIGS. 16C and 17) needs to be relocked, that is, its holder plate 212 needs to be elevated so that chess pieces 174 can be deposited into its compartments 214 during play. Holder plate 212 is elevated by pushing locking handle 218 into drawer 210. In FIG. 16B, triangular catch 242 can be pushed through hole 219 since triangular catch 242 can recede temporarily into inner tube 234 (FIG. 19) as it passes through hole 219.

After both halves of chess box 170 have been open and set, and both drawers relocked, the game can proceed. The replacement of chess pieces 174 during play is the same procedure as that described above in connection with the embodiment of FIG. 1.

When a chess game has ended and both drawers have been refilled with chess pieces 174, chess box 170 can now be reset for a new game. The first step is to slide drawer 210 into chess box 170 so that ramp 213 is positioned as shown in FIG. 16B. Now board half 184 is rotated 180 degrees onto drawer 210 below it, so that grooves 206, 208 of board half 184 are lined up and placed over flat springs 254, 256 of drawer 210 (as in FIG. 16B, except that holder plate 212 would be in the elevated position here). The last step is to slide the drawer (which will carry board half 184 along with it) into the locked position as shown in FIG. 16. Flat spring 192 (FIG. 16C) will be pressed into recess 190 as drawer 210 is slid into chess box 170. Flat spring 192 will automatically lock drawer 210 into chess box 170 when it once again catches indentation 270 as shown in FIG. 16.

This embodiment of the self-setting chessboard game device has several advantages over the embodiment of FIG. 1. The embodiment of FIG. 13 allows the use of taller chess pieces 174 than in the first embodiment without impairing the ability to release them from their holder plate 212 as shown in FIG. 16. In contrast, the ability to free the chess pieces from their holders in the design of the first embodiment necessitates using short chess pieces. In the embodiment of FIG. 13, the chess piece holder plates make use of simple compartments to hold chess pieces instead of the more elaborate conical compartments used in the first embodiment. The reason for this is that chess pieces of the second embodiment are freed from their holder plate before rotation as in FIG. 16B and do not require the more precise positioning that the chess pieces of the first embodiment do to clear their holders as shown in FIG. 10. Another advantage is that the surfaces of the chessboard halves in the second embodiment cannot be scratched by the dragging magnets of the chess pieces as in the first since the board halves are reinserted together with the drawers as in FIG. 16B. The second embodiment has a simplified and integrated locking mechanism in the locking handles of its drawers, which simultaneously locks a drawer inside chess box 170 and its corresponding chessboard half as locking handle 218 does in FIG. 16. In contrast, the first embodiment requires separate drawer locks and chessboard half locks. The design of the second embodiment provides a better appearance than the first since the front walls of the chess box are closed off by the drawers as in FIG. 13. In contrast, in the first embodiment, the drawers are inserted deep inside of chess box 30, and the front sides of chess box 30 appear open as shown in FIGS. 1 and 3.

Figure 24:
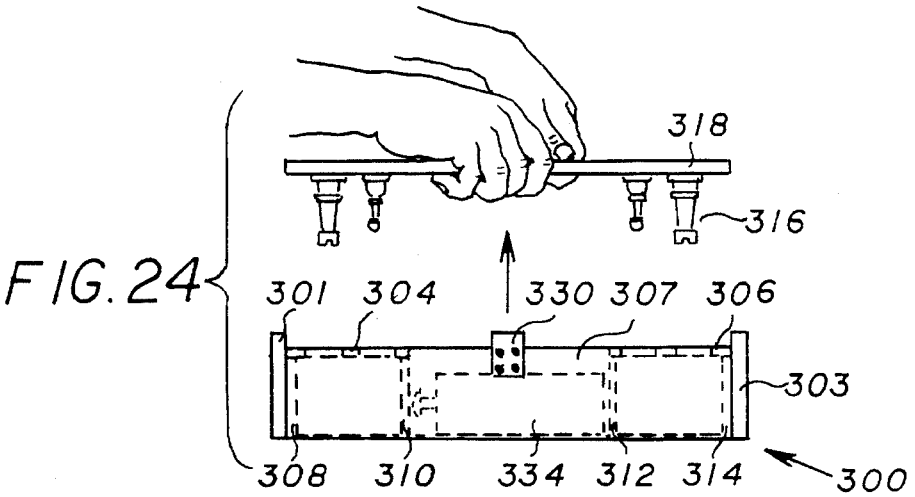
FIG. 24 is an exploded side elevational view of a third embodiment of a game set and storage system according to the invention.
Figure 26:
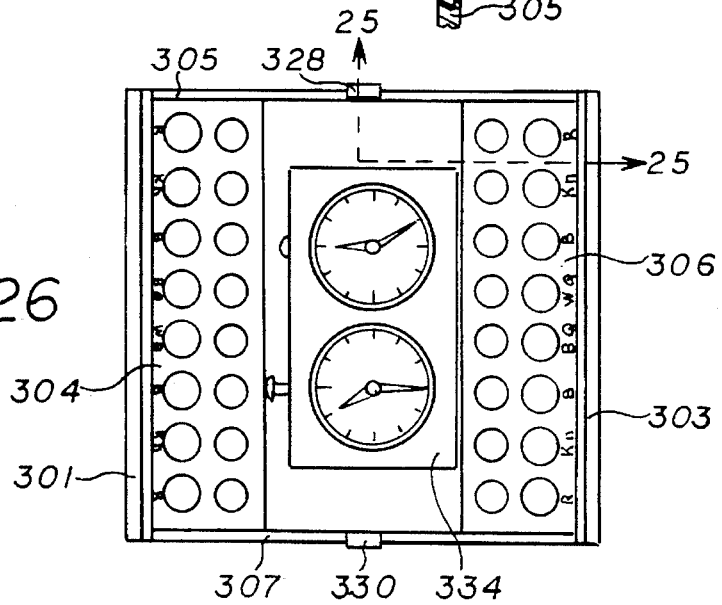
FIG. 26 is a top plan view of the embodiment of FIG. 24, with the game board removed.

A third embodiment of a chess set and storage box 300 is shown in FIG. 24. Chess box 300 consists of an open top and two elevated sides 301, 303 as well as two supporting sides 305, 307 as shown in FIGS. 24 and 26. Chess box 300 contains two non-removable chess piece holder plates 304, 306 for holding chess pieces 316, as shown with dotted lines from the side in FIG. 24 and from the top in FIG. 26. Holder plate 304 is supported by walls 308, 310, and holder plate 306 is supported by walls 312, 314 as shown in FIG. 24. Holder plates 304, 306 each have 16 compartments of appropriate size arranged into two rows of eight as shown in FIG. 26. The rows of compartments closest to the center of chess box 300 contain pawns, while the outer rows of holder plates 304, 306 contain the larger chess pieces (King, Queen, Bishops, Rooks, Knights). Holder plates 304, 306 are labeled with abbreviations for the corresponding chess pieces they hold (shown for holder plate 306) as in the previous embodiments. Chess pieces 316 are held by holder plates 304, 306 in an upside down position by their bases (not shown) as in the previous embodiment, and have magnets positioned in their bases as shown in FIG. 3A.

Figure 27:
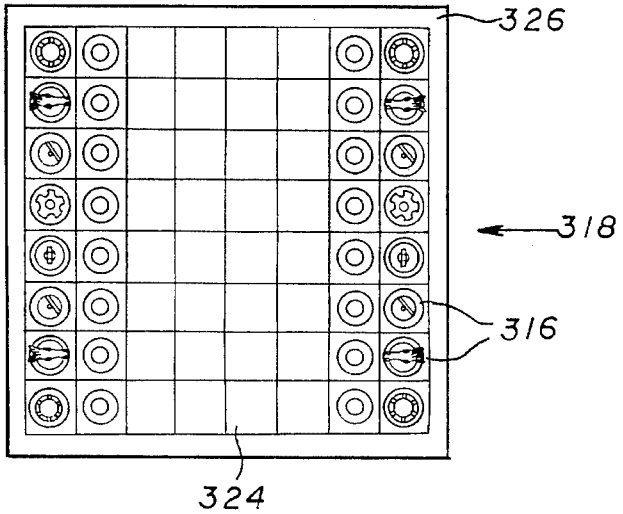
FIG. 27 is a top plan view of the embodiment of FIG. 24, with the board in a playing position and the game pieces set up for play.

In the closed position of chess box 300, its top surface is covered by a chessboard 318 which faces downwards (not shown). In FIG. 24, chessboard 318 is shown right after being lifted from the top of chess box 300. Chessboard 318 is a one piece board, not split into two halves as in the previous embodiments. Chessboard 318 consists of a square plastic sheet 320 on the surface of which is attached a steel sheet 322 of equal size, shown sectionally in FIG. 25. The chessboard pattern is displayed by a chessboard sticker 324, which covers the outer surface of steel sheet 322, as shown in FIG. 27. Chessboard sticker 324 includes the 64 checker squares which are enclosed by a border 326.

Figure 25:
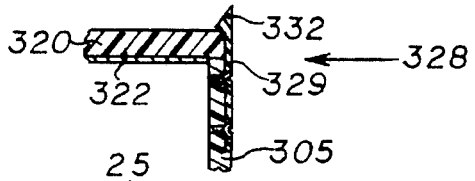
FIG. 25 is an enlarged fragmentary cross-sectional view of the embodiment of FIG. 24.

Supporting sides 305, 307 have chessboard locks 328, 330 attached near the middle of their outer sides as shown in FIGS. 25 and 26. Chessboard lock 328 consists of a flat spring 329 which has a triangular catch 332 attached to its free end used to hold chessboard 318 in place in the closed position of chess box 300 as shown in FIG. 25. Chessboard lock 330 is identical to chessboard lock 328.

In the closed position of chess box 300, chessboard 318 rests upside down on supporting sides 305, 307 of chess box 300 and covers holder plates 304, 306 so that chess pieces 316 are magnetically attached upside down onto the appropriate squares of chessboard sticker 324 (not shown). To open chess box 300 and start a game, the triangular catches of chessboard locks 328, 330 are pushed outward while lifting chessboard 318 as in FIG. 24. Since chess pieces 316 are magnetically attached to steel sheet 322, this action lifts all the chess pieces out of holder plates 304, 306. Chessboard 318 with all pieces set in place is then rotated 180 degrees by hand, and placed on a table top next to empty chess box 300. Holder plates 304, 306 are not removable as they are with the drawers in the previous two embodiments, but remain in chess box 300 where chess pieces 316 are deposited upside down during play similarly as in the previous two embodiments. When a game is finished and all chess pieces 316 have been replaced into holders 304, 306, chessboard 318 is then placed upside down over chess box 300 while pushing the triangular catches of chessboard locks 328, 330 outward to allow chessboard 318 to descend onto supporting walls 305, 307 as in FIG. 25 in the locked position. Chess box 300 is now ready for another game. The center of chess box 300 has empty space inside as shown in FIG. 26, and can be used to hold a chess clock 334 for example, or other objects.

This embodiment of the self-setting chessboard game device has the advantage over the previous two in that it is much simpler in design, and does not require a split chessboard or removable drawers. Also each side is not independently operated, but both sides of the chessboard are setup together through the lifting operation shown in FIG. 24. In addition, chessboard 318 is removable from chess box 300, and rests on a tabletop as a conventional thin chessboard. Also, the rows of compartments in holder plates 304, 306 are positioned so they correspond to the normal position of chess pieces on a chessboard (with the exception of the positions of the black and white queens being reversed), while in the previous embodiments, the rows are reversed.

Figure 28:
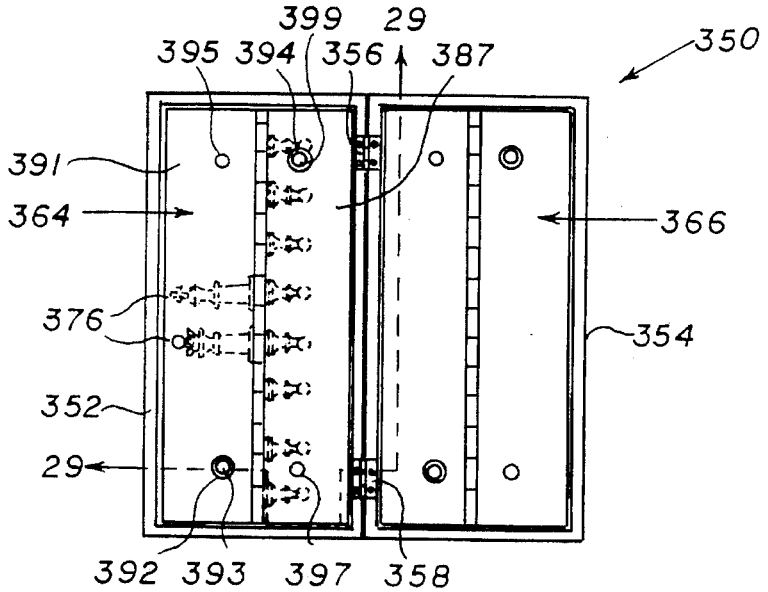
FIG. 28 is a top plan view of a fourth embodiment of a game set and storage system according to the invention in an open position.
Figure 31:
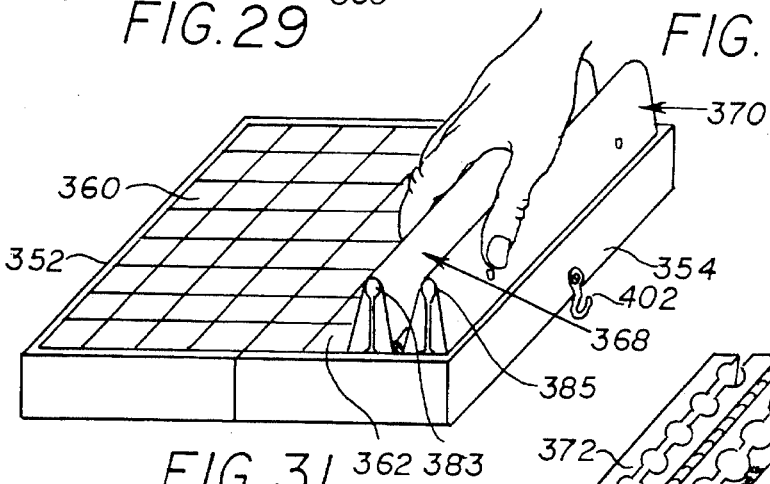
FIG. 31 is an axonometric view of an the embodiment of FIG. 28, with the game board in a playing position and an open game piece holder on the surface of the board.
Figure 32:
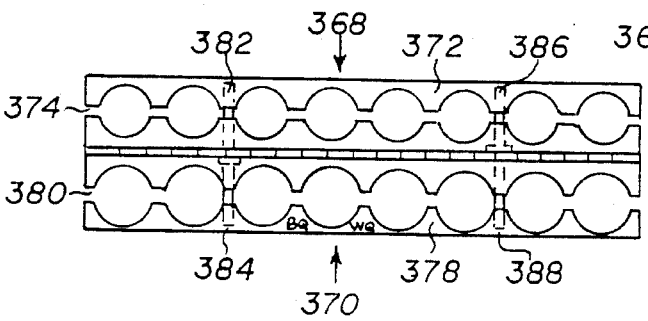
FIG. 32 is a top plan view of the game piece holder of FIG. 30.
Figure 33:
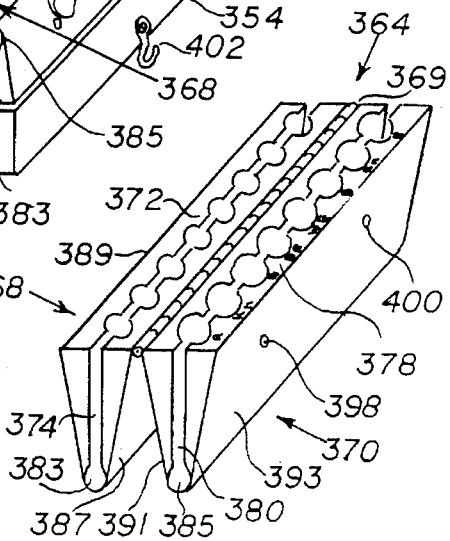
FIG. 33 is an axonometric view of the game piece holder of FIG. 30.

A fourth embodiment of a chess set and storage box 350 is shown in FIG. 28. Chess box 350 is foldable and consists of two similar box halves 352, 354, hinged together by hinges 356, 356 as shown in FIG. 28. Box half 354 has a hook 402 on one of its side walls as shown in FIG. 31, which locks to box half 352 when box halves 352, 354 are folded together along hinges 356, 358 into the closed position of chess box 350 (not shown). The chessboard surfaces 360, 362 of box halves 352, 354 each carry half of the chessboard pattern. Box halves 352, 354 contain identical chess piece holders 364, 366 shown in their closed state in FIG. 28, and shown sectionally for holder 364 in FIG. 29. Holders 364, 366 are held in box halves 352, 354 by means of friction. In FIG. 33, holder 364 is shown empty in its open standing position. Holder 364 consists of two hollow wedge-shaped troughs 368, 370 of equal size, each formed by inner and outer walls 387, 389 and 391, 393 as shown in FIG. 33. Troughs 368, 370 are made preferably of thin flexible plastic material. Inner and outer walls 387, 389 of trough 368 converge together and form a rounded edge 383 that traverses their length, and are separated at all other points to form slot 374. Inner and outer walls 391, 393 of trough 370 also converge together to form a similar rounded edge 385, and also are separated at all other points to form slot 380. The rounded edges 383, 385 of troughs 368, 370 provide flexibility and function as flat springs to allow slots 374, 380 to expand. This spring action of rounded edges 383, 385 is employed in the mechanism for releasing the chess pieces as described in detail below. Inner walls 387, 391 of troughs 368, 370 are held together by a hinge 369 which spans their length. Hinge 369 allows holder 364 to be folded into a closed position as in FIG. 29. Troughs 368, 370 have chess piece holder plates 372, 378 across the tops of their inner and outer walls as shown in FIGS. 32 and 33. Holder plates 372, 378 each have a row of eight compartments and are split in the middle by slots 374, 380. Holder plate 372 is used to contain the pawns of chess pieces 376, and holder plate 378 contains the other larger chess pieces as partially shown with dotted lines in FIG. 28, where holder 364 is in the closed position. Holder plate 378 is labeled with abbreviations for the corresponding chess pieces it holds, visible in FIGS. 32 and 33. In FIG. 33, chess pieces 376 are deposited during play into the appropriate compartments of holder plates 372, 378 in an upside down position as in the previous embodiments, where they are held in place. The inside surfaces of the inner and outer walls 387, 389 and 391, 393 of troughs 368, 370 are lined with a felt material 381 (shown sectionally for through 370 in FIG. 29) to more securely hold chess pieces 376, and to prevent them from being scratched.

Figure 29:
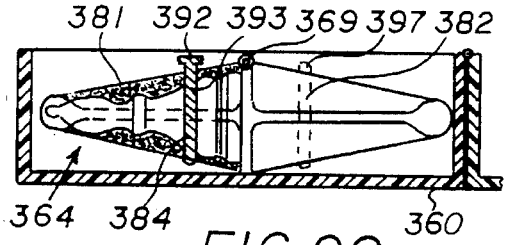
FIG. 29 is a cross-sectional view taken along line 29—29 in FIG. 28.
Figure 30:
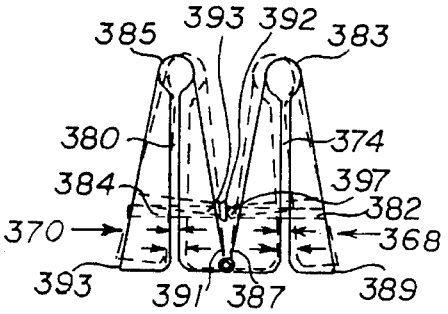
FIG. 30 is a side elevational view of a game piece holder in the embodiment of FIG. 28, with the game piece holder shown in an open position.

Troughs 368, 370 contain rods 382, 386 and 384, 388, passing across them as shown in FIG. 32. Rods 382, 384 are also shown in FIG. 29 and 30. Rods 384, 388 of trough 370 are attached by one of their ends to the inside of outer wall 393 at points 398, 400 as shown in FIG. 33. Rods 382, 386 of trough 368 are also attached by one of their ends to the inside of outer wall 389 at the same level as points 398, 400 (not shown). Rods 384, 388 protrude through holes in inner wall 391 to form free ends 393, 395 as shown in FIG. 28. Rods 382, 386 also protrude through holes in inner wall 387 to form free ends 397, 399. Free ends 393, 399 have flanges 392, 394 attached to them as shown in FIG. 28, and shown for free ends 393, 397 in FIGS. 29 and 30.

When chess box 350 is opened as in FIG. 28, holder 364 is removed through lifting by means of flanges 392, 394 which function as handles. Holder 364 is then opened along hinge 369 while in the air into the position in FIG. 30, by pushing together the rounded edges 383, 385 of troughs 368, 370 as shown in FIG. 31. Holder 364 is then positioned over chessboard surface 362 of box half 354 (or equivalently over chessboard surface 360) as shown in FIG. 31, lining up troughs 368, 370 over their rows of corresponding squares. Chess pieces 376 are released from troughs 368, 370 by squeezing together their rounded edges 383, 385 as in FIGS. 30 and 31. This pressure causes the rods' free ends 393, 395 to push against free ends 397, 399 as shown for free ends 393, 397 in FIG. 30. This results in inner and outer walls 387, 389 and 391, 393 to assume the new position shown with dotted lines in FIG. 30, where inner walls 387, 391 have moved inwardly, increasing the widths of slots 374, 380 as shown by the arrows, which allows chess pieces 376 to be released onto chessboard surface 362 as in FIG. 31. Holder 364 is then freely lifted and placed on a tabletop so that it stands on the rounded edges 383, 385 of its troughs as in FIG. 33. Chess pieces 376 are deposited upside down during a game into holders 364, 366, and when they both have been refilled, they are closed by rotating their troughs along their hinges into a flat position as in FIG. 29, and placed into box halves 352, 354 as in FIG. 28.

The embodiment of FIG. 28 has several advantages over the previous three. In contrast to the embodiments where chess pieces are stored vertically in the chess boxes, chess pieces of the fourth embodiment are stored in a horizontal position when inside chess box 350, allowing the chess box to be smaller by being a conventional foldable-type chess game box. Chess pieces with magnets in their bases are not required for the setting process, which allows the surface of the chessboard to be fabricated of a wider variety of materials, although a magnetic set could, of course, be provided, if desired. The design of the holders of the fourth embodiment are particularly well suited for use with small chess pieces and chessboards, including portable chessboards.

Figure 34:
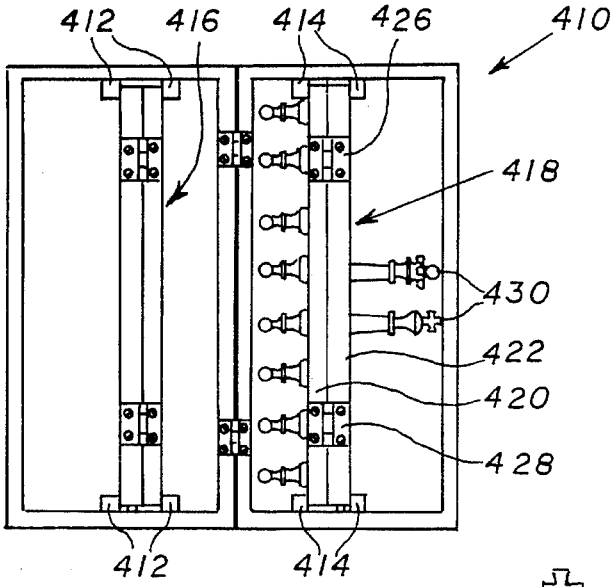
FIG. 34 is a top plan view of a fifth embodiment of a game set and storage system according to the invention in an open position.

A fifth embodiment of a chess set and storage box 410 is shown in FIG. 34. This embodiment is similar in many ways to the embodiment of FIG. 28, although there are some essential differences which provide certain advantages.

Figure 35:
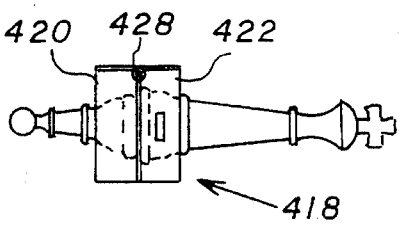
FIG. 35 is a side elevational view a game piece holder in the embodiment of FIG. 34 in a closed position.
Figure 36:
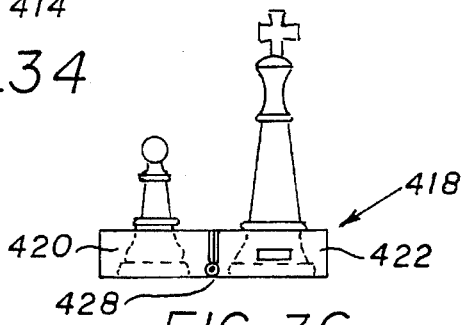
FIG. 36 is a side elevational view of the game piece holder of FIG. 35 in an open position.
Figure 37:
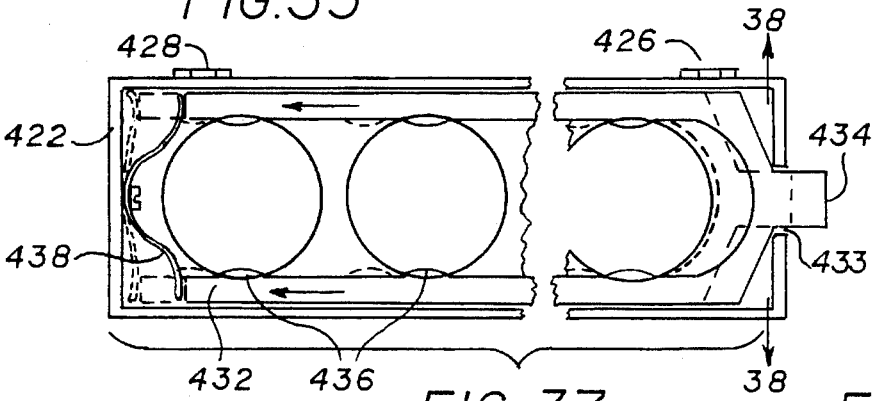
FIG. 37 in an enlarged fragmentary view, partly broken away, of the game piece holder of FIG. 35.
Figure 38:
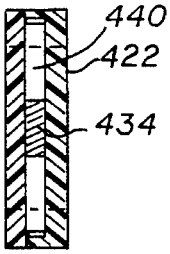
FIG. 38 is a cross-sectional view taken along line 38—38 in FIG. 37.
Figure 40:
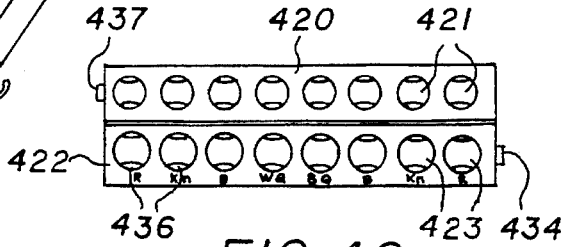
FIG. 40 is a top plan view of the game piece holder of FIG. 35 in an open position.

As in the previous embodiment, the embodiment of FIG. 34 also employs foldable chess piece holders 416, 418 which store chess pieces 430 in a horizontal position when inside a foldable chess box 410. Holders 416, 418 are identical. Chess box 410 is similar to chess box 350, with the only difference being that chess box 410 contains guides 412, 414 which are used to position and hold chess piece holders 416, 418. Holder 418 has a rectangular shape and is divided along its length into two holder halves 420, 422 of equal size, held together by hinges 426, 428, shown in FIGS. 34, 35, and 36. Each holder half 420, 422 contains a row of eight compartments 421, 423 (FIG. 40) for holding chess pieces 430. Holder half 422 of holder 418 is shown sectionally in FIG. 38, containing a slot 440 running horizontally through its length. The other holder half 420 of holder 418 also has a similar slot (not shown). Holder 418 is shown in the closed position in FIG. 35, where holder halves 420, 422 are folded against each other by hinges 426, 428. In FIG. 36 holder 418 is shown in its open or unfolded position. Holder half 420 contains the pawns of chess pieces 430 while holder half 422 contains the other larger chess pieces. Holder half 422 is labeled with abbreviations for the corresponding chess pieces it contains as shown in FIG. 40. Chess pieces 430 are deposited rightside up during play into the compartments of holders 416, 418, as shown for holder 418 in FIG. 36. Holder half 422 of holder 418 is shown in an enlarged fragmentary view in FIG. 37. Slot 440 of holder half 422 contains a locking fork 432 which has 16 protrusions 436, eight on the inner side of each arm corresponding to the positions of compartments 423 as shown in FIG. 40. One end of locking fork 432 forms a button 434 and protrudes out of a hole 433 in an end of holder half 422 as shown in FIGS. 37 and 40. The other end of holder half 422 contains a flat spring 438 inside of slot 440 attached such that both arms of locking fork 432 push against it when button 434 is pressed, making locking fork 432 spring loaded, as shown in FIG. 37. Holder half 420 has an identical spring loaded fork in its slot with a button 437 shown in FIG. 40. When chess pieces 430 reside in the compartments of holder half 422 and button 434 is not depressed, they are held in place by protrusions 436, which overlap with the compartments of holder half 422. When button 434 is depressed, locking fork 432 moves to the position shown with dotted lines in FIG. 37, and protrusions 436 move out of the compartments of holder half 422, thus releasing chess pieces 430. Protrusions 436 are of a rubber material so as not to damage chess pieces 430 when holding them.

Figure 39:
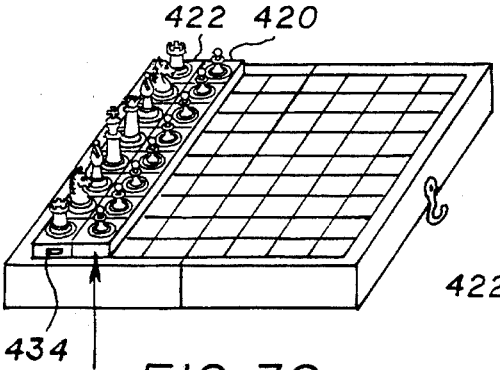
FIG. 39 is an axonometric view of the embodiment of FIG. 34 in an open position, with a game piece holder in an open position on the surface of the game board.

When starting a game, holder 418 is placed over its corresponding rows of squares on chess box 410 as shown in FIG. 39, and buttons 434, 437 are depressed to release chess pieces 430. Holder 418 is then lifted up over chess pieces 430 and placed on the tabletop as in FIG. 40. During play, when the captured chess pieces are deposited into compartments 421, 423 of holder 418, they are placed on top of the overlapping protrusions. When holder 418 has been filled, buttons 434, 437 of both holder halves are momentarily depressed to allow the chess pieces to fall through the compartments to the level of the tabletop below. The chess pieces are now securely locked in place. Before closing chess box 410, holder 418 is folded as in FIG. 35 and replaced into chess box 410, where it is securely held by either guides 412 or 414 as in FIG. 34. Holder 416 is similarly operated as holder 418.

The embodiment of FIG. 34 has several advantages over the previous embodiment. Larger chess pieces can be stored in holders 416, 418 when inside chess box 410 (FIG. 34) than in the embodiment of FIG. 28, where space is wasted on the pawn sides of the folded holders. In the fifth embodiment, chess pieces are deposited in an upright position during play into holders 416, 418 which allows the players to more easily keep track of the captured pieces than in the fourth embodiment, where captured chess pieces are deposited upside down in their holders and are hidden. Holders 416, 418 are much smaller and are less noticeable on the tabletop than the holders of the fourth embodiment. The design of the holders of this embodiment are well suited for large size chess pieces and chessboards.

Figure 41:
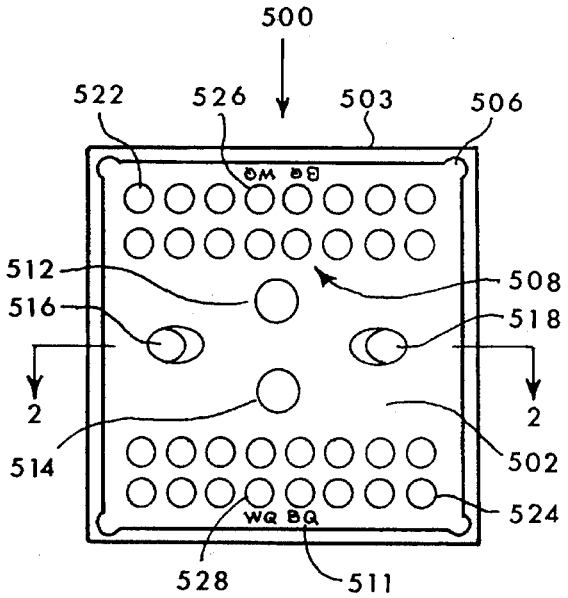
FIG. 41 is a top plan view of a sixth embodiment of a game set and storage system according to the invention, with the game board removed.
Figure 41A:
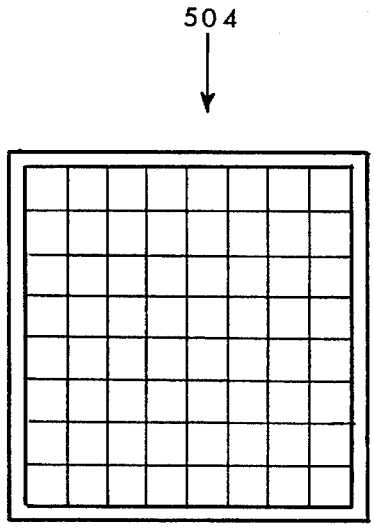
FIG. 41A is a top plan view of the game board in the embodiment of FIG. 41.
Figure 42:
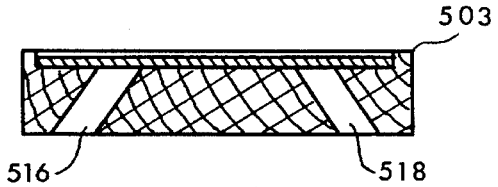
FIG. 42 is a cross-sectional view taken along line 42—42 in FIG. 41.
Figure 43:
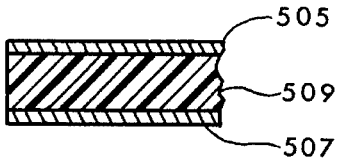
FIG. 43 is an enlarged fragmentary sectional view of the game board in the embodiment of FIG. 41.

In the embodiment of FIG. 41, chess piece holder 500 consists of a base in the form of a generally rectangular, solid block of material such as wood. A square recess 502 is formed in the upper portion of the block and opens through the upper surface of the block, with an upstanding flange or lip 503 extending about the perimeter of the recess. The lateral dimensions of the recess are slightly greater than the length and width of a chessboard 504 which is received in the recess, and the recess is also somewhat deeper than the thickness of the chessboard.

The recess has rounded corners 506 which extend into the peripheral flange or lip and receive the corners of the chessboard. The rounded corners have an arc length on the order of 180 degrees, which makes them deep enough to receive the square corners of the board and also permits them to be formed by a router bit which moves laterally into the corners without being raised from the recessed area. This enables the entire recess to be formed efficiently by an automated routing process.

Chessboard 504 is formed as a laminated structure consisting of three layers: two outer layers 505, 507 of relatively thin steel and a central layer of plastic 509 which provides rigidity. The upper and lower surfaces of the chessboard have a similar chessboard pattern imprinted thereon by a suitable process such as screen printing. Alternatively, the outer layers can be a polycarbonate material such as Lexan, with the inner layer being fabricated of steel or another magnetic material. The polycarbonate material has a significant advantage in that it provides a playing surface which is highly resistant to scratches.

Chess piece holder 500 has a plurality of holes 508 formed therein and opening through the bottom wall of recess 502 for receiving the chess pieces and holding them in an inverted position. The holes are arranged in two groups of 16 holes each positioned toward opposite ends of the holder in alignment with the starting positions of chess pieces 510 on the chess board. As in some of the previous embodiments, the chess pieces have magnets (not shown) in their bases which serve to hold the pieces on the board. The holes vary in depth according to the heights of the chess pieces such that the bases of chess pieces 510 will be flush with the surface of recess 502 when they are placed in the holes. Labels 511 are provided on the holder to indicate the chess pieces that the different holes are intended to hold. When chessboard 504 is placed in the recess, it is positioned with the squares on the board in registration with holes 508 for placing the chess pieces in alignment with the proper squares on the board.

A pair of magnets 512, 514 are mounted in the upper portion of holder 500, with the upper surfaces of the magnets being generally level with the bottom surface of the recess, for holding the chessboard in place in the recess.

Figure 44:
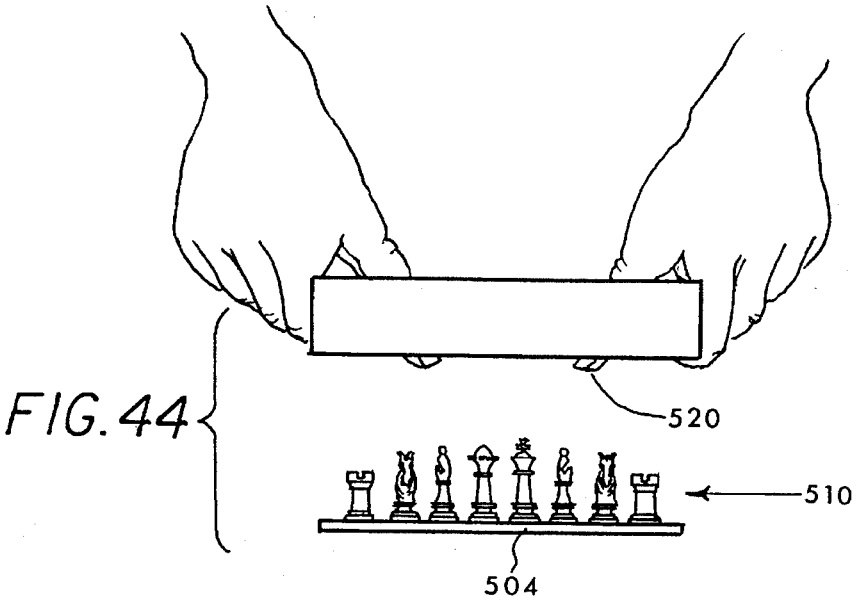
FIG. 44 is a side elevational view of the embodiment of FIG. 41, with the game board and game pieces being removed from the holder.

A pair of oval-shaped finger holes 516, 518 extend through holder 500 from the recess to the lower surface of the block. These holes are positioned on the lateral or transverse centerline between the two ends of the holder where holes 508 are located. They are inclined vertically at an angle on the order of 10 to 45 degrees to match the natural angles of the thumbs 520 of a person holding the holder in an inverted position with his thumbs extending into the holes from above. In the inverted position, the finger holes are inclined downwardly and inwardly, as illustrated in FIG. 44.

If desired, instead of being a solid block of wood, chess piece holder or base 500 can be fabricated of a material such as plastic, and it can be formed by a process such as injection molding.

At the start of a game, holder 500 is placed on a table or other flat surface (not shown) in an inverted position, with chess pieces 510 in holes 508, chessboard 504 in recess 502, and peripheral flange or lip 503 resting against the surface. The board and pieces are released from the holder by a player inserting his thumbs into finger holes 516, 518 from above and pressing against the back side of chessboard 504 to release the board from magnets 512, 514, as shown in FIG. 44. To release the board, it is not necessary to lift the holder off the supporting surface since recess 502 is deep enough to allow the board to drop free from the attractive force of the magnets with the peripheral flange or lip resting on the surface. The holder is then lifted in an upward direction to expose the board with the pieces in the starting positions on the upper surface of the board. As the holder is lifted, the magnets in the bases of the pieces keep the pieces in position in case the holder should contact them.

During play, holder 500 is placed right side up, and the chessboard can be placed in recess 502 for play, with magnets 512, 514 holding the board in place. Alternatively, the board can be positioned to one side of the holder, in which case captured pieces can be placed in holes 508 as soon as they are removed from the board.

When the game is finished, the set can be returned to its closed or storage position. If the board has been placed in the recess on top of the holder, it can be removed by inserting the index or middle fingers into the finger holes 516, 518 from the under side of the holder and pressing against the lower side of the board. The chess pieces are placed in an inverted position in the holes 508 in the holder, and the chessboard is placed in the recess, with the chess pieces in alignment with their starting positions. The board is retained on the holder by magnets 512, 514, and the pieces are secured to the board by the magnets in the pieces.

Proper orientation between the chess pieces and the board is obtained by positioning the board in the recess with one of the white corner squares on the upper side of the board in registration with one of the rook holes 522, 524 which are to the right of the white queen holes 526, 528 (labeled WQ in FIG. 41).

This embodiment has certain advantages over the previous embodiments. It does not require magnetic chess pieces for the setting process (though still preferable to use them for overall stability), since the chess pieces are dropped out of the holder instead of lifted out. This dropping action is more stable that the lifting action as in the previous embodiments, where chess pieces can be accidentally knocked off in the process, or the chess piece magnets could eventually lose strength and not cling adequately to the chessboard. The set is maintained in its closed position by the magnets which hold the chessboard on the holder, without any other locking mechanism. The overall design is simpler and less costly to produce.

Figure 45:
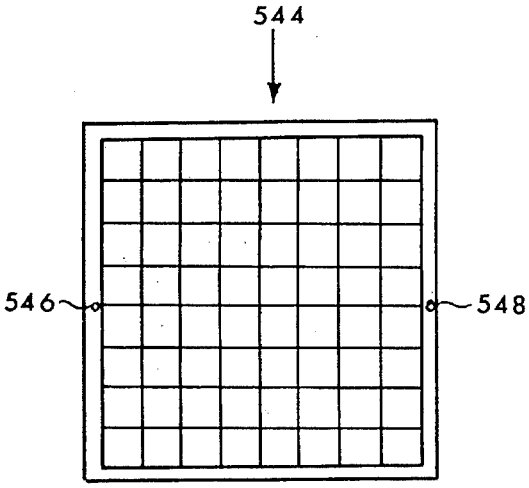
FIG. 45 is a top plan view of a seventh embodiment of a game set and storage system according to the invention.
Figure 45A:
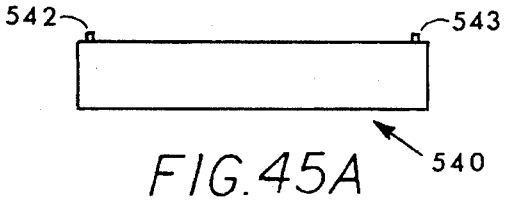
FIG. 45A is a side view of a game piece holder in the embodiment of FIG. 45.

FIGS. 45–45A show a similar embodiment which has a holder 540 and a chessboard 544. Holder 540 is similar to holder 500, except that holder 540 has a flat top surface with no recess, and has a pair of registration pins 542, 543 which extend upwardly from opposite ends of the top surface. Board 544 has a pair of corresponding holes 546, 548 in which the pins are received when the board is positioned properly on the holder, i.e. with the proper squares on the playing surface aligned with the game pieces in the holder.

Operation and use of the embodiment of FIGS. 45–45A is similar to that of the previous embodiment, except that without recess 502, the holder must be lifted away from the board and chess pieces at the same time that the thumbs are pressed through the finger holes to release the board from the holding force of the magnets in the holder.

Figure 46:
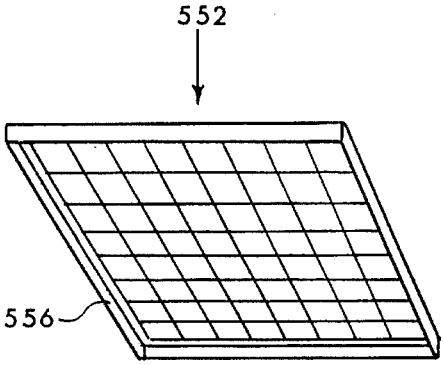
FIG. 46 is an axonometric bottom view of the game board in the embodiment of FIG. 45.
Figure 46A:
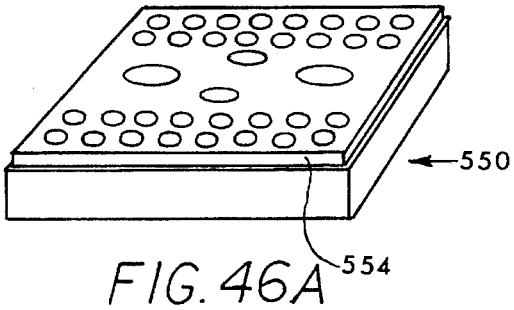
FIG. 46A is an axonometric view of the game piece holder in the embodiment of FIG. 45.

FIGS. 46–46A show another similar embodiment which includes a holder 550 and a chessboard 552. In this embodiment, the holder has a rabbet or groove 554 which extends around the upper periphery of the holder. The board has a peripheral skirt or flange 556 which fits into the groove to register the board in the proper position with respect to the holder. The dimensions of the flange or skirt correspond to those of the rabbet or groove, and the outer surface of the flange or skirt is flush with the side of the holder when the board is on the holder.

Operation and use of this embodiment is similar to that of the embodiment of FIGS. 45–45A, except that players may not want to place the board on the holder during the play of a game since there is no means for holding the board in registration with the holder when the skirt or flange is facing up.

Figure 47:
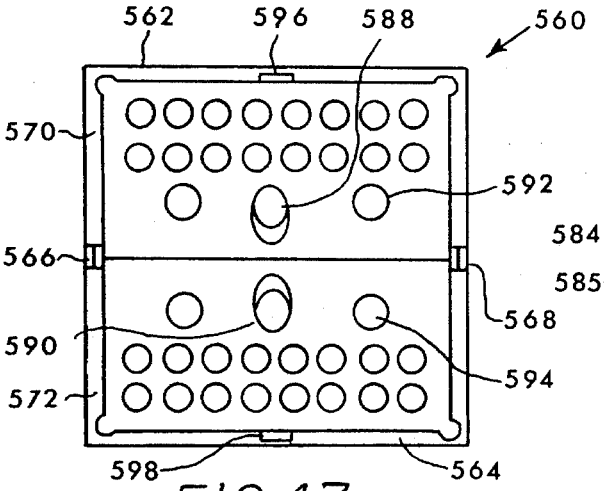
FIG. 47 is a top plan view of an eighth embodiment of a game set and storage system according to the invention, with the game board removed.
Figure 48:
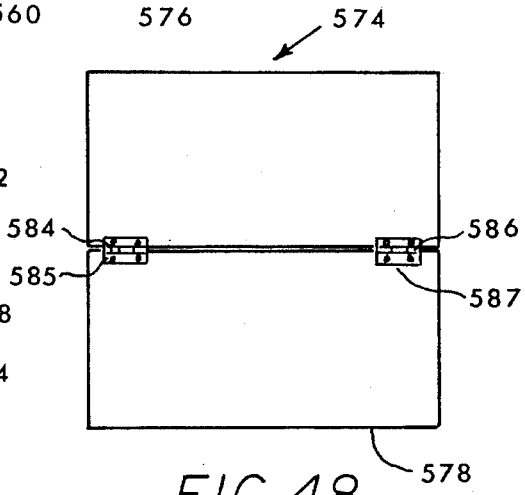
FIG. 48 is a bottom plan view of the game board in the embodiment of FIG. 47.
Figure 48A:
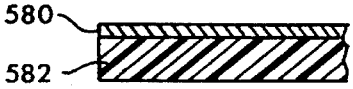
FIG. 48A is a fragmentary enlarged sectional view of the game board in the embodiment of FIG. 47.
Figure 49:
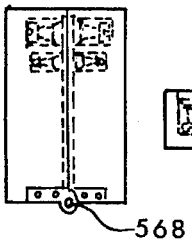
FIG. 49 is a side elevational view of the embodiment of FIG. 47, with game piece holder in a closed position.
Figure 50:
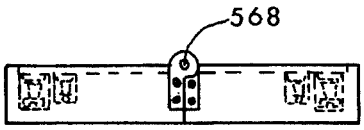
FIG. 50 is a side elevational view of the embodiment of FIG. 47, with the game piece holder in an open position and the game board and game pieces in an inverted position.

FIGS. 47–49 show an embodiment similar to the embodiment of FIGS. 41–44, except that the holder 560 and the chessboard 574 are each formed in two sections which are connected together by hinges. Holder 560 has two identical halves 562, 564 connected together by hinges 566, 568 located toward the upper edges of side walls 570, 572. The two sections of the holder can thus be folded together or closed for storage as shown in FIG. 49 or opened flat for play as shown in FIG. 50. In the closed or storage position, the recessed areas in the two halves of the holder come together face-to-face, and the peripheral flanges or lips 570, 572 abut together.

Chessboard 574 has two identical halves 576, 578 which are hinged together on their under or back sides by hinges 584, 586. This board has a relatively thin steel sheet or layer 580 on its upper or front side only, with a relatively thick plastic sheet or substrate 582 beneath the steel layer. Steel sheet or layer 580 has a chessboard pattern imprinted upon its upper surface. The hinges are mounted in mortises 585, 587 in the plastic substrate, with the outer surfaces of the hinge plates flush with the bottom side of the board. For storage, chessboard 574 is placed in the recess on the upper side of the holder with the playing surface facing down and the hinges facing up.

The holder has a pair of finger holes 588, 590 similar to finger holes 516, 518, with one finger hole in each half of the holder. These finger holes are located on the centerline which is perpendicular to the two ends of the holder, rather than on the transverse or lateral centerline where the hinges are. Each section of the holder also has a pair of round magnets 592, 594 embedded in the upper portion of the block on opposite sides of the finger hole for retaining the chessboard in the recess.

Rectangular magnets 596, 598 are mounted in the peripheral flange or lip on the outer sides of the two holder sections for holding the two sections together in the closed or storage position.

Operation and use of this embodiment is similar to that of the embodiment of FIGS. 41–44, with the additional feature that in this embodiment, this holder and board can be folded for storage. To do so, the board is placed in the recess with the playing surface facing down as in the previous embodiments. With the board in that position, the two halves of the board are folded together as the two halves of the holder are brought together, and the board is thus stored in its folded position inside the compartment formed by the recessed areas in the two halves of the holder.

Figure 51:
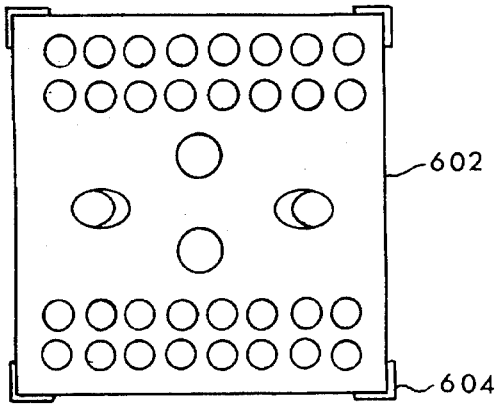
FIG. 51 is a top plan view of a ninth embodiment of a game set and storage system according to the invention, with the game board removed.
Figure 52:
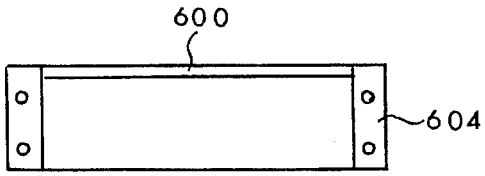
FIG. 52 is a side elevational view of the embodiment of FIG. 51.
Figure 53:
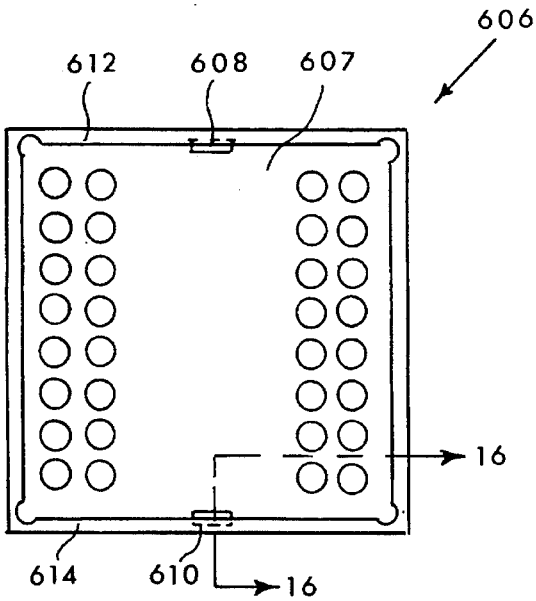
FIG. 53 is a top plan view of a tenth embodiment of a game set and storage system according to the invention, with the game board removed.
Figure 54:
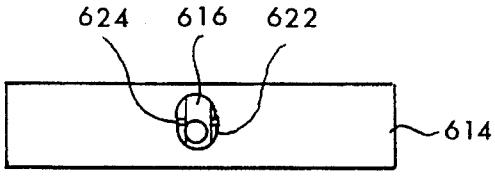
FIG. 54 is a side elevational view of the embodiment of FIG. 53.
Figure 55A:
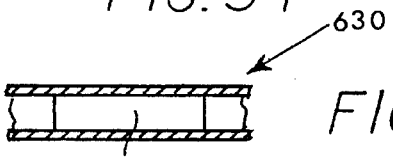
FIG. 55A is a fragmentary sectional view of the game board in the embodiment of FIG. 53.
Figure 55B:
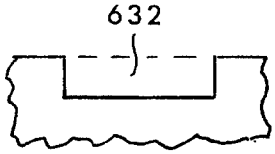
FIG. 55B is a fragmentary top view, partly broken away, of the game board in the embodiment of FIG. 53.

The embodiment of FIGS. 51–52 is generally similar to the embodiment of FIGS. 41–44 and includes a chessboard 600 and a holder 602. Holder 602 has a flat top surface with no recess, with L-shaped cornerpieces 604 projecting above the top surface at the four corners of the holder. The cornerpieces receive the corners of the chessboard and thus serve as guides for registering the board in the proper position on the holder. As illustrated in FIG. 52, the cornerpieces extend above the top surface of the holder by a distance corresponding to the thickness of the board, and the upper surface of the board is generally flush with the upper edges of the cornerpieces.

In this embodiment, as in the embodiment of FIGS. 45–45A, the holder must be lifted away from the board as the board is being pressed away from the magnets with the thumbs. Otherwise, operation and use of the embodiment of FIGS. 51–52 is similar to that of the embodiment of FIGS. 41–44.

The embodiment of FIGS. 53–57 includes a holder 606 which is similar to holder 500, with a recess 607 similar to recess 502 but no magnets for holding the board in the recess and no finger holes for releasing the board from the holder.

Figure 56:
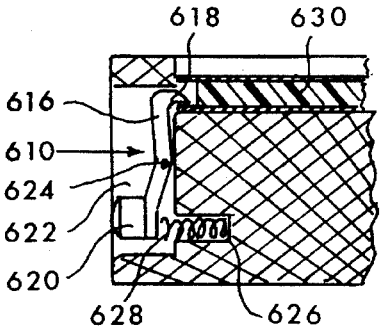
FIG. 56 is a fragmentary cross-sectional view taken along line 16—16 in FIG. 53, showing the game board in a locked position in the game piece holder.
Figure 57:
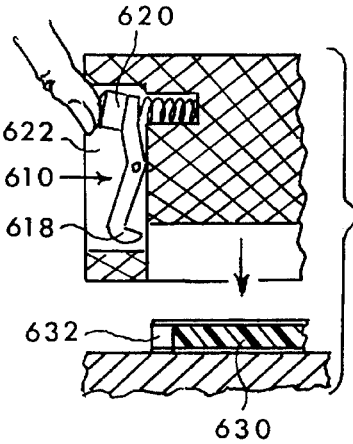
FIG. 57 is a view similar to FIG. 56, with the game piece holder in an inverted position, and the game board dropped from the holder onto a table below.

In this embodiment, the board is held in the recess by a pair of spring locks 608, 610 mounted in the side walls 612, 614 of the holder. Each of these locks comprises a rocker arm 616 having an inwardly facing hook or latch 618 at the upper end thereof and an outwardly facing button 620 at the lower end thereof. The rocker arm is mounted in an oval shaped opening 622 in the side wall. This opening extends through the upper portion of the side wall and opens into recess 607 as shown in FIG. 56. The rocker arm is mounted for pivotal movement within the opening by a pivot pin 624. A helical spring 628 mounted in a hole 626 engages the back side of the rocker arm behind the button and urges the hook or latch in an inward direction toward its locking position.

Recess 607 houses a chessboard 630 which is similar to chessboard 504, except it has slots 632, 634 at opposite ends thereof for receiving the hooks or latches of the spring locks. In the locking position, the hooks or latches extend into the slots and hold the board in the recess. To release the board and chess pieces from the holder, the holder is inverted, and buttons 620 are depressed. This withdraws the hooks or latches from the slots, thereby releasing the board so that the holder can be lifted away from the board with the chess pieces resting thereon.

During play, chessboard 630 can be placed on top of the holder, with the hooks or latches of spring locks engaging the slots and holding the board in the recess. As can be seen in FIG. 56, the upper surfaces of the hooks or latches are tapered, and the rocker arms will deflect out and then snap back into position as the board is pressed into the recess.

It is apparent from the foregoing that a new and improved game set and storage system have been provided. While only certain presently preferred embodiments have been described in detail, as will be apparent to those familiar with the art, certain changes and modifications can be made without departing from the scope of the invention as defined by the following claims.

We claim:

1. In a game set: a plurality of game pieces, a holder comprising a solid block having a recessed area on one side thereof, a plurality of compartments formed in the block beneath the recessed area for holding the game pieces in an inverted position with the lower surfaces of the game pieces facing in an upward direction, a game board disposed in the recessed area in an inverted position with a playing surface on one side of the board facing in a downward direction and being aligned in a predetermined manner with the game pieces in the compartments, means releasably retaining the game board in the recessed area, and a finger hole in the block opening into the recessed area for insertion of a finger to press the board away from the holder.

2. The game set of claim 1 wherein the means releasably retaining the game board in the recessed area comprises a magnet carried by the block.

3. The game set of claim 1 including magnets carried by the game pieces for securing the game pieces to the board.

4. The game set of claim 1 wherein the block has a peripheral surface which extends around the recessed area and engages an edge portion of the game board to maintain the board in a predetermined position on the holder.

5. The game set of claim 4 wherein the recessed area and the game board are rectangular, and the recessed area has rounded corners in which corners of the game board are received.

6. The game set of claim 1 wherein the finger hole extends through the block and is inclined vertically at an angle on the order of 10°–45°.

7. The game set of claim 1 wherein the holder and the game board are each formed in two sections which are hinged together and adapted to be folded together for storage when the board is in the inverted position on the holder.

8. The game set of claim 1 wherein the block is fabricated of wood.

9. The game set of claim 1 wherein the block is generally rectangular.

10. In a game set: a plurality of game pieces, a single holder comprising a base having a top surface, a plurality of compartments formed in the base and opening through the top surface for holding all of the game pieces in an inverted position with the lower surfaces of the game pieces facing in an upward direction, a game board disposed on the top surface in an inverted position with a playing surface on one side of the board facing in a downward direction, means for positioning the board in a predetermined position on the top surface of the holder, and means releasably securing the board to the holder, so that when all of the game pieces are positioned inverted in the compartments, and the inverted game board is secured to the top surface of the holder in the predetermined position, the game board and the holder can be flipped over, so that when the holder is released and removed from the game board, all of the game pieces are simultaneously positioned on the playing surface of the game board.

11. The game set of claim 10 wherein the means for positioning the board comprises a registration pin carried by the holder and a hole in the board for receiving the pin when the board is in the predetermined position.

12. The game set of claim 10 wherein the means for positioning the board comprises a peripheral flange which extends downwardly from the board and engages an upper portion of the base.

13. The game set of claim 12 wherein the flange is received in a peripheral groove in the upper portion of the base.

14. The game set of claim 10 wherein the means for positioning the board comprises a cornerpiece which projects upwardly from a corner of the base and engages a corner portion of the board.

15. The game set of claim 10 including a finger hole in the base opening through the top surface for insertion of a finger to press the board away from the holder.

16. The game set of claim 10 wherein the base comprises a generally rectangular block of wood.

17. In a game set: a plurality of game pieces, a single holder comprising a base having a recessed area on one side thereof, a plurality of compartments formed in the base beneath the recessed area for holding all of the game pieces in an inverted position with the lower surfaces of the game pieces facing in an upward direction, a game board disposed in the recessed area in an inverted position with a playing surface on one side of the board facing in a downward direction, a peripheral surface which extends around the recessed area and engages an edge portion of the game board to maintain the board in a predetermined position on the holder with the playing surface aligned with the game pieces in the compartments, and a latch mounted on the base and engagable with the board for releasably securing the board to the holder, so that when all of the game pieces are positioned inverted in the compartments, and the inverted game board is secured to the top surface of the holder in the predetermined position, the game board and the holder can be flipped over, so that when the holder is released and removed from the game board, all of the game pieces are simultaneously positioned on the playing surface of the game board.

18. The game set of claim 17 wherein the latch comprises a rocker arm pivotally mounted on the base with a hook extending in an inward direction at a first end of the arm, an operating button extending in an outward direction at a second end of the arm, and a spring engaged with the arm yieldably urging the first end to pivot in an inward direction to bring the hook into engagement with an edge portion of the board.

19. The game set of claim 17 wherein the base comprises a generally rectangular block of wood.

20. In a game set: a plurality of game pieces, a holder comprising a base having a recessed area on one side thereof, a plurality of compartments formed in the base beneath the recessed area for holding the game pieces in an inverted position with the lower surfaces of the game pieces facing in an upward direction, a game board disposed in the recessed area in an inverted position with a playing surface on one side of the board facing in a downward direction and being aligned in a predetermined manner with the game pieces in the compartments, means releasably retaining the game board in the recessed area, and a finger hole opening into the recessed area for insertion of a finger to press the board away from the holder.

21. The game set of claim 20 wherein the playing surface of the game board is fabricated of a polycarbonate material.

* * * * *